US009859627B2

(12) United States Patent
Yamamoto et al.

(10) Patent No.: US 9,859,627 B2
(45) Date of Patent: Jan. 2, 2018

(54) CONNECTION STRUCTURE OF TERMINAL FITTING AND CONNECTION METHOD OF TERMINAL FITTING

(71) Applicant: YAZAKI CORPORATION, Tokyo (JP)

(72) Inventors: Takatatsu Yamamoto, Shizuoka (JP); Keiichi Mita, Shizuoka (JP); Takehiko Uehara, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/489,363

(22) Filed: Apr. 17, 2017

(65) Prior Publication Data

US 2017/0310019 A1 Oct. 26, 2017

(30) Foreign Application Priority Data

Apr. 26, 2016 (JP) ..... 2016-088212
Feb. 3, 2017 (JP) ..... 2017-018627

(51) Int. Cl.
*H01R 4/10* (2006.01)
*H01R 4/18* (2006.01)
*H01R 11/12* (2006.01)
*H01R 11/32* (2006.01)

(52) U.S. Cl.
CPC ..... *H01R 4/185* (2013.01); *H01R 11/12* (2013.01); *H01R 11/32* (2013.01)

(58) Field of Classification Search
CPC ..... H01R 11/32; H01R 11/12; H01R 4/185
USPC ..... 439/879, 877, 880, 585
See application file for complete search history.

(56) References Cited

U.S. PATENT DOCUMENTS 6,334,798 B1 * 1/2002 Ushijima ..... H01R 4/187 439/203
7,462,062 B2 * 12/2008 Kumakura ..... H01R 4/182 439/422
8,043,131 B2 * 10/2011 Ngo ..... H01R 4/20 439/877
8,105,121 B2 * 1/2012 Miyamoto ..... H01R 4/646 439/883
9,039,435 B2 * 5/2015 Horiuchi ..... H01R 4/64 439/287

(Continued)

FOREIGN PATENT DOCUMENTS

JP 2006-40759 A 2/2006

*Primary Examiner* — Abdullah Riyami
*Assistant Examiner* — Nelson R Burgos-Guntin
(74) *Attorney, Agent, or Firm* — Kenealy Vaidya LLP

(57) ABSTRACT

A terminal fitting includes a terminal body and a plurality of terminal connection sections. A connection terminal is connected to an electric wire. The connection terminal has a holding space defined by a pair of fastening caulking pieces provided on both side sections of the connection terminal and upper end sections of the pair of fastening caulking pieces which are folded back inwardly. A pair of caulked pieces is provided so as to stand upright on both side sections of the terminal connection section and is configured to be accommodated in the holding space. A provisional engaging mechanism that is detachably engaged with the pair of fastening caulking pieces when the pair of caulked pieces is accommodated in the holding space and is provided between the pair of caulked pieces and the pair of fastening caulking pieces.

9 Claims, 16 Drawing Sheets

(56) References Cited

U.S. PATENT DOCUMENTS

| | | | | |
|---|---|---|---|---|
| 9,039,466 | B2 * | 5/2015 | Iio | H01R 4/182 439/677 |
| 9,153,880 | B2 * | 10/2015 | Omori | H01R 4/64 |
| 2001/0003688 | A1 * | 6/2001 | Kondo | B29C 45/14426 439/604 |
| 2003/0171042 | A1 * | 9/2003 | Miyazaki | H01R 13/748 439/859 |
| 2004/0142607 | A1 * | 7/2004 | Asakura | H01R 43/0221 439/877 |
| 2010/0197179 | A1 * | 8/2010 | Miyamoto | H01R 4/646 439/877 |
| 2011/0021092 | A1 * | 1/2011 | Ukai | H01R 4/185 439/877 |
| 2012/0244759 | A1 * | 9/2012 | Tsuji | H01R 4/029 439/877 |
| 2014/0011411 | A1 * | 1/2014 | Matsushita | H01R 4/185 439/877 |
| 2015/0064991 | A1 * | 3/2015 | Kawamura | H01R 4/183 439/879 |
| 2015/0079825 | A1 * | 3/2015 | Miyamoto | H01R 4/206 439/152 |
| 2015/0364835 | A1 * | 12/2015 | Tonoike | H01R 43/0488 439/879 |
| 2015/0364838 | A1 * | 12/2015 | Tonoike | H01R 4/187 439/879 |
| 2016/0079684 | A1 * | 3/2016 | Naganishi | H01R 11/12 439/877 |
| 2016/0104955 | A1 * | 4/2016 | Marson | H01R 4/185 439/585 |
| 2017/0155200 | A1 * | 6/2017 | Yamamoto | H01R 4/04 |
| 2017/0155202 | A1 * | 6/2017 | Yamamoto | H01R 11/09 |
| 2017/0155220 | A1 * | 6/2017 | Uehara | H01R 4/185 |
| 2017/0201051 | A1 * | 7/2017 | Yamamoto | H01R 4/18 |

* cited by examiner

CONNECTION STRUCTURE OF TERMINAL FITTING AND CONNECTION METHOD OF TERMINAL FITTING

CROSS REFERENCE TO RELATED APPLICATIONS

This application is based on Japanese Patent Application (No. 2016-088212) filed on Apr. 26, 2016 and Japanese Patent Application (No. 2017-018627) filed on Feb. 3, 2017 and, the contents of which are incorporated herein by reference.

BACKGROUND OF THE INVENTION

1. Field of the Invention

The present invention relates to a connection structure and a connection method of a terminal fitting and relates to a provisional engaging structure and a provisional engaging method of a terminal fitting and a connection terminal.

2. Description of the Related Art

A connection structure is known in which the connection plates of a plurality of terminal fittings to which a plurality of grounding wires is connected are stacked mutually, a common bolt is inserted into mounting holes provided in the connection plates, and the bolt is fastened to a grounding face (for example, a predetermined position of a vehicle body), whereby the plurality of grounding wires is collectively conducted to the grounding face via the stacked terminal fittings (for example, refer to JP-A-2006-40759).

However, in the case of the above-mentioned structure in which the terminal fittings are stacked and fastened with the bolt, the terminal fittings connected to the respective grounding wires are stacked and fastened with the bolt, the weight of the terminal fittings increases as the number of the grounding wires increases. Furthermore, the thickness of the stacked terminal fittings increases as the number of the grounding wires increases, whereby a large space for accommodating the terminal fittings is required to be secured above the grounding face. Moreover, since fastening work is done after bolt/nut length adjustment associated with the stacking of the terminal fittings has been completed, the work takes time.

Still further, in the case of the fastening using the bolt, the bolt may become loose, and the connection reliability after the connection may be degraded in some cases. If connection terminals to which electric wires are connected are crimped and fastened to the terminal fittings to solve this problem, a strong connection structure is obtained. However, the relative postures of the connection terminals become unstable when the connection terminals are crimped with a crimping machine and there is a danger of causing fluctuations in crimping strength due to positional displacement or the like.

SUMMARY OF THE INVENTION

The present invention has been made in consideration of the above-mentioned circumstances, and objects of the present invention are to provide a connection structure and a connection method of a terminal fitting capable of collectively conducting and connecting a plurality of electric wires at high connection reliability by crimping and fastening, to the terminal fitting, a plurality of connection terminals to which electric wires are connected, and to provide a provisional engaging structure and a provisional engaging method of the terminal fitting and connection terminals.

The above-mentioned objects of the present invention can be attained by the configurations described in the following items (1) to (9).

(1) A provisional engaging structure of a terminal fitting and connection terminals, comprising:

the terminal fitting comprising:

a terminal body; and a plurality of terminal connection sections extended from the terminal body; and the connection terminal configured to be connected to an end section of an electric wire, wherein the connection terminal has a holding space defined by a pair of fastening caulking pieces provided so as to stand upright on both side sections of the connection terminal and upper end sections of the pair of fastening caulking pieces which are folded back inwardly, the pair of fastening caulking pieces being capable of caulking and fastening the connection terminal to the terminal fitting;

wherein a pair of caulked pieces is provided so as to stand upright on both side sections of the terminal connection section and is configured to be accommodated in the holding space of the connection terminal; and wherein a provisional engaging mechanism that is detachably engaged with the pair of fastening caulking pieces when the pair of caulked pieces is accommodated in the holding space is provided between the pair of caulked pieces and the pair of fastening caulking pieces.

With the provisional engaging structure of the terminal fitting and the connection terminals configured as described in the above-mentioned item (1), before the connection terminal is caulked and fastened to the terminal fitting, the pair of caulked pieces of the terminal connection section of the terminal fitting and the fastening caulking pieces of the connection terminal are set to a provisional engaging state so as to be detachably engaged by the provisional engaging mechanism.

Hence, a harness in which the terminal fitting and a plurality of connection terminals are set to the provisional engaging state can be moved between processing steps, and the connection terminals can be caulked and fastened to the terminal fitting in a later processing step, whereby the degree of freedom of harness assembling work increases. Furthermore, since the terminal fitting and the plurality of connection terminals being set to the provisional engaging state are detachably engaged, in the case that misconnection is found between the terminal fitting and the connection terminals by a continuity check in the provisional engaging state, circuit correction can be made easy.

As the provisional engaging mechanism, the engaging protruding sections making contact with the electric wire-side side faces of the fastening caulking pieces are provided, whereby the terminal fitting and the plurality of connection terminals can be set to the provisional engaging state. In other words, the engaging protruding sections can be formed easily on the pair of caulked pieces by performing press working or the like, and increase in processing cost can be suppressed.

Furthermore, since the engaging protruding sections are configured as engaging arms that are formed at the upper end sections of the pair of caulked pieces so as to be flexibly deformable in the disengaging direction thereof, the insertion force to be exerted at the time when the pair of caulked pieces are inserted into the holding space can be decreased.

Moreover, since the insertion guide having a narrow tip end to be inserted and guided at the time when the terminal connection section is inserted into the holding space is formed at the tip end section of the terminal connection section, the insertion property of the terminal connection section at the time when the pair of caulked pieces are inserted into the holding space can be improved.

(2) The provisional engaging structure of the terminal fitting and connection terminals set forth in the above-mentioned item (1), wherein the provisional engaging mechanism comprises:

engaging protruding sections respectively provided so as to protrude at tip end sections of the upper end sections of the pair of caulked pieces and so as to make contact with the electric wire-side side faces of the pair of fastening caulking pieces; and relief sections respectively provided so as to be cut out at tip end sections of bottom section sides of the pair of caulked pieces to avoid interference with the connection terminal when the tip end section of the terminal connection section is inserted into the holding space obliquely.

With the provisional engaging structure of the terminal fitting and the connection terminals configured as described in the above-mentioned item (2), the tip end section of the terminal connection section in which the engaging protruding sections are provided so as to protrude and the relief sections are formed on the bottom section sides of the pair of caulked pieces is inserted into the holding space of the connection terminal along the insertion direction while being rotated (rocked) obliquely.

Consequently, in comparison with a case in which the tip end section of the terminal connection section is inserted straight into the holding space of the connection terminal in the axial line direction, the protruding height of the engaging protruding section can be increased, and the holding force (provisional engaging force) of the terminal connection section for the connection terminal being in the provisional engaging state can be increased. Furthermore, the insertion force at the time when the tip end section of the terminal connection section is inserted into the holding space of the connection terminal can be decreased, whereby smooth inserted can be performed.

(3) The provisional engaging structure of the terminal fitting and connection terminals set forth in the above-mentioned item (1), wherein the provisional engaging mechanism comprises a pair of engaging protruding sections provided so as to protrude at tip end sections of upper end sections of the pair of caulked pieces and so as to be respectively opposed to both side faces of the pair of fastening caulking pieces along a connection direction of the connection terminal.

With the provisional engaging structure of the terminal fitting and the connection terminals configured as described in the above-mentioned item (3), the fastening caulking pieces of the connection terminal are set to a provisional engaging state while being positioned in the connection direction by the two pairs of engaging protruding sections provided so as to protrude at the tip end section of the terminal connection section.

Hence, the positioning accuracy at the time when the fastening caulking pieces of the connection terminal are caulked and fastened to the pair of caulked pieces of the terminal fitting is improved, whereby the connection terminal can be caulked and fixed to the terminal connection section of the terminal fitting with high accuracy.

(4) The provisional engaging structure of the terminal fitting and connection terminals set forth in the above-mentioned item (1), wherein the provisional engaging mechanism comprises an engaging protruding piece provided so that a tip end of the upper end section of one of the caulked piece is bent to outside of the tip end section thereof so as to make contact with only the electric wire-side side face of one of the pair of fastening caulking pieces.

With the provisional engaging structure of the terminal fitting and the connection terminals configured as described in the above-mentioned item (4), when the tip end section of the terminal connection section is inserted into the holding space of the connection terminal, the engaging protruding piece can pass through the clearance between the pair of fastening caulking pieces. Hence, even if the protruding height of the engaging protruding piece is increased, the engaging protruding piece can be inserted smoothly with a small insertion force. Furthermore, since the connection terminal is rotated around the axial line along the insertion direction of the terminal connection section, the engaging protruding piece is opposed to the electric wire-side side face so as to intersect one of the fastening caulking pieces, whereby the connection terminal can be set securely to a provisional engaging state with respect to the tip end section of the terminal connection section.

(5) A connection structure of a terminal fitting, wherein the pair of fastening caulking pieces of the connection terminal set forth in any one of the above-mentioned items (1) to (4) is caulked to the pair of caulked pieces, and the connection terminal is caulked and fastened to the terminal fitting.

With the provisional engaging structure of the terminal fitting and the connection terminals configured as described in the above-mentioned item (5), when the terminal fitting is connected to a plurality of electric wires via the connection terminals, the reliability of the electrical connection therebetween is maintained by caulking and fastening.

Further, when the fastening caulking pieces are caulked to the pair of caulked pieces, since the pair of caulked pieces and the fastening caulking pieces are set to the provisional engaging state, defects caused by fluctuations in crimping strength due to positional displacement or the like during caulking can be suppressed. Still further, since the pair of caulked pieces and the fastening caulking pieces are set to the provisional engaging state, the plurality of connection terminals can be caulked and fixed to the terminal fitting simultaneously.

As a result, the plurality of electric wires can be conducted and connected to the terminal fitting collectively by caulking and fastening the connection terminals to the terminal fitting. Hence, the terminal fitting is not required to be stacked in comparison with a structure in which terminal fittings connected to respective electric wires are stacked, fastened and conducted, whereby, even if the number of the electric wires increases, the increase in the weight of the terminal fitting can be suppressed. Furthermore, since the terminal fitting is not required to be stacked, even if the number of the electric wires increases, the thickness of the terminal fitting 10 does not increase, whereby space saving is attained.

In addition, since the structure of the terminal fitting is configured such that the connection terminals separated from the terminal fitting are caulked, fastened and connected to the terminal fitting, the connection terminals to which the electric wires having different sizes in diameter are connected can be caulked, fastened and conducted to the terminal connection sections. In other words, the electric wires having various sizes can be connected without changing the connection configuration between the terminal connection sections of the terminal fitting and the fastening connection sections of the connection terminals. Furthermore, the increase/decrease in the number of the electric wires to be conducted can be easily dealt with by preparing the terminal fittings being different in the number of the terminal connection sections. As a result, the terminal fittings having minimum necessary variation can be used to deal with the changes in the number and size of the electric wires to be conducted.

Moreover, since the structure of the terminal fitting is configured such that the connection terminals are fastened to the plurality of terminal connection sections of the terminal fitting, the connection terminals can be caulked and fastened to the terminal connection sections as necessary, whereby the number of the electric wires to be conducted collectively can be increased/decreased easily within the range of the number of the terminal connection sections.

(6) A provisional engaging method of a terminal fitting and connection terminals in a connection of the terminal fitting having a terminal body and a plurality of terminal connection sections extended from the terminal body, a pair of fastening caulking pieces of the connection terminal connected to an end section of an electric wire caulking to a pair of caulked pieces provided on both side sections of the terminal connection section, the provisional engaging method comprising:

forming a holding space capable configured to accommodate the pair of caulked pieces in the connection terminal by folding back inward upper end sections of the pair of fastening caulking pieces provided so as to stand upright on both side sections of the connection terminal; and detachably engaging the pair of fastening caulking pieces with the pair of caulked pieces using a provisional engaging mechanism provided between the terminal connection section and the connection terminal by inserting the pair of caulked pieces into the holding space.

With the provisional engaging method of the terminal fitting and the connection terminals configured as described in the above-mentioned item (6), before the connection terminal is caulked and fastened to the terminal fitting, the pair of caulked pieces of the terminal connection section of the terminal fitting and the fastening caulking pieces of the connection terminal can be set to a provisional engaging state so as to be detachably engaged by the provisional engaging mechanism.

Hence, a harness in which the terminal fitting and the plurality of connection terminals are set to the provisional engaging state can be moved between processing steps, and the connection terminals can be caulked and fastened to the terminal fitting in a later processing step, whereby the degree of freedom of harness assembling work increases. Furthermore, since the terminal fitting and the plurality of connection terminals being set to the provisional engaging state are detachably engaged, in the case that misconnection is found between the terminal fitting and the connection terminals by a continuity check in the provisional engaging state, circuit correction can be made easy.

(7) The provisional engaging method of the terminal fitting and connection terminals set forth in the above-mentioned item (6), wherein the provisional engaging mechanism comprises engaging protruding sections provided so as to protrude at tip end sections of upper end sections of the pair of caulked pieces and so as to make contact with the electric wire-side side faces of the fastening caulking pieces; and wherein the upper end section of one of the fastening caulking pieces is hooked to a base end section side portion of the upper end section of one of the pair of caulked pieces, and the connection terminal is rotated around an axis along an insertion direction of the terminal connection section by using the upper end section of the one of the pair of caulked pieces as a fulcrum, whereby the pair of caulked pieces is accommodated into the holding space.

With the provisional engaging method of the terminal fitting and the connection terminals configured as described in the above-mentioned item (7), the pair of caulked pieces can be accommodated in the holding space while the fastening caulking pieces are not elastically deformed upward by the engaging protruding sections. Hence, the protruding height of the engaging protruding sections can be increased, whereby it is possible to increase the holding force (provisional engaging force) of the terminal connection section to the connection terminal that is in the provisional engaging state.

Furthermore, the pair of caulked pieces can be accommodated in the holding space by hooking the upper end section of one of the fastening caulking pieces to the base end section side of the upper end section of one of the pair of caulked pieces and by elastically deforming the tip ends of the pair of fastening caulking pieces in the widening direction while rotating the connection terminal around the axial line along the insertion direction of the terminal connection section by using the upper end section of the one of the pair of caulked pieces as a fulcrum. Hence, the pair of caulked pieces can be accommodated in the holding space of the connection terminal by applying a slight rotation operation load, whereby the fastening caulking pieces can be set to the provisional engaging state.

(8) The provisional engaging method of the terminal fitting and connection terminals set forth in the above-mentioned item (6), wherein the provisional engaging mechanism comprises an engaging protruding piece provided so that a tip end of the upper end section of one of the caulked pieces is bent to outside of the tip end section thereof so as to make contact with only the electric wire-side side face of one of the pair of the fastening caulking pieces; and wherein the tip end section of the terminal connection section is inserted into the holding space by passing the engaging protruding piece through a clearance between the pair of fastening caulking pieces, and then the connection terminal is rotated around an axis along an insertion direction of the terminal connection section, whereby the pair of caulked pieces is accommodated into the holding space.

With the provisional engaging method of the terminal fitting and the connection terminals configured as described in the above-mentioned item (8), the tip end section of the terminal connection section is inserted into the holding space of the connection terminal such that the engaging protruding piece making contact with only the electric wire-side side face of the one of the pair of the fastening caulking pieces passes through the clearance between the pair of fastening caulking pieces, whereby even if the protruding height of the engaging protruding piece is increased, the tip end section of the terminal connection section can be inserted smoothly into the holding space of the connection terminal with a small insertion force. After that, the connection terminal is rotated around the axial line along the insertion direction of the terminal connection section, whereby the engaging protruding piece is opposed to the electric wire-side side face so as to intersect the one of the fastening caulking pieces, and the connection terminal can be set securely to a provisional engaging state with respect to the tip end section of the terminal connection section.

(9) A connection method of a terminal fitting having a terminal body and a plurality of terminal connection sections extended from the terminal body, a pair of fastening caulking pieces of a connection terminal connected to an end section of an electric wire caulking to a pair of caulked pieces provided on both side sections of the terminal connection section, the connection method comprising:

forming a holding space configured to accommodate the pair of caulked pieces in the connection terminal by folding back inward upper end sections of the pair of fastening caulking pieces provided so as to stand upright on both side sections of the connection terminal;

detachably engaging the pair of fastening caulking pieces with the pair of caulked pieces using a provisional engaging mechanism provided between the terminal connection section and the connection terminal by inserting the pair of caulked pieces into the holding space; and caulking the pair of caulked pieces inside the holding space by crushing the fastening caulking pieces.

With the provisional engaging method of the terminal fitting and the connection terminals configured as described in the above-mentioned item (9), the terminal connection section is inserted and provisionally engaged in the holding space that is preliminarily formed in the connection terminal, and the fastening caulking pieces are crushed so as to be caulked and fastened to the pair of caulked pieces that is formed on the terminal connection section inserted inside the holding space, whereby the caulking fastening work can be performed in a state in which the posture of the terminal connection section with respect to the connection terminal is maintained stable.

Hence, defects caused by fluctuations in crimping strength due to positional displacement or the like during caulking can be suppressed. Still further, since the pair of caulked pieces and the fastening caulking pieces are set to the provisional engaging state, the plurality of connection terminals can be caulked and fixed to the terminal fitting simultaneously in the caulking step. As a result, the plurality of electric wires can be conducted and connected to the terminal fitting collectively by caulking and fastening the connection terminals to the terminal fitting.

The present invention can provide a connection structure and a connection method of a terminal fitting capable of collectively conducting and connecting a plurality of electric wires at high connection reliability while suppressing weight and saving space, and can also provide a provisional engaging structure and a provisional engaging method of the terminal fitting and connection terminals.

The present invention has been described above briefly. Moreover, the details of the present invention will be further clarified by reading the descriptions of the modes (hereafter referred to as "embodiments") for embodying the invention to be described below referring to the accompanying drawings.

BRIEF DESCRIPTION OF THE DRAWINGS

FIG. 1A is a perspective view showing the terminal fitting to which grounding wires are connected, and FIG. 1B is a plan view showing the terminal fitting to which the grounding wires are connected;

FIG. 2A is a perspective view showing the terminal fitting and the connection terminals, and FIG. 2B is a plan view showing the terminal fitting and the connection terminals;

FIG. 5A is a cross-sectional view taken on line B-B of FIG. 5B, FIG. 5B is a cross-sectional view taken on line A-A of FIG. 5A, FIG. 5C is a cross-sectional view taken on line D-D of FIG. 5D, and FIG. 5D is a cross-sectional view taken on line C-C of FIG. 5C;

FIG. 6A is a cross-sectional view taken on line F-F of FIG. 6B, FIG. 6B is a cross-sectional view taken on line E-E of FIG. 6A, FIG. 6C is a cross-sectional view taken on line H-H of FIG. 6D, and FIG. 6D is a cross-sectional view taken on line G-G of FIG. 6C;

FIG. 10A is a main part cross-sectional view showing the terminal fitting and the connection terminal according to the second embodiment, and FIG. 10B is a main part cross-sectional view showing a terminal fitting and a connection terminal according to a reference example;

FIG. 15A is a perspective view showing the connection terminal provisionally engaged with the terminal connection section of the terminal fitting, and FIG. 15B is a cross-sectional view taken on line J-J of FIG. 15A.

DETAILED DESCRIPTION OF THE EXEMPLARY EMBODIMENTS

Embodiments according to the present invention will be described below referring to the accompanying drawings.

First, a connection structure of a terminal fitting and a provisional engaging structure of the terminal fitting and connection terminals according to a first embodiment of the present invention will be described.

Figure 1A:
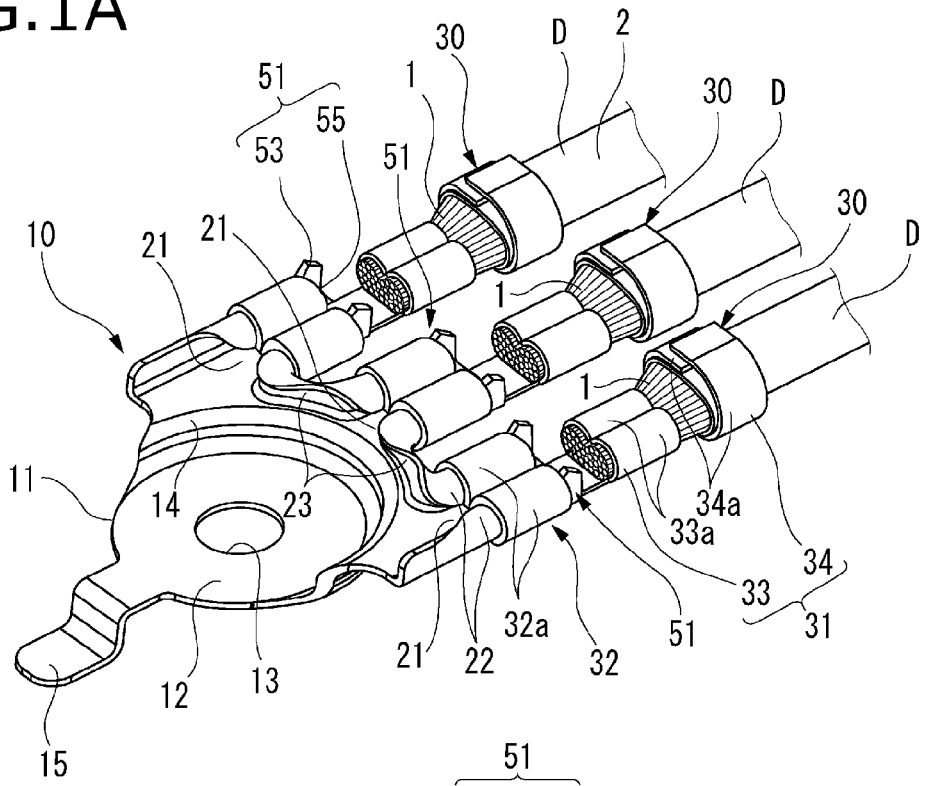
FIGS. 1A and 1B are views illustrating a connection structure of a terminal fitting according to a first embodiment of the present invention.
Figure 1B:
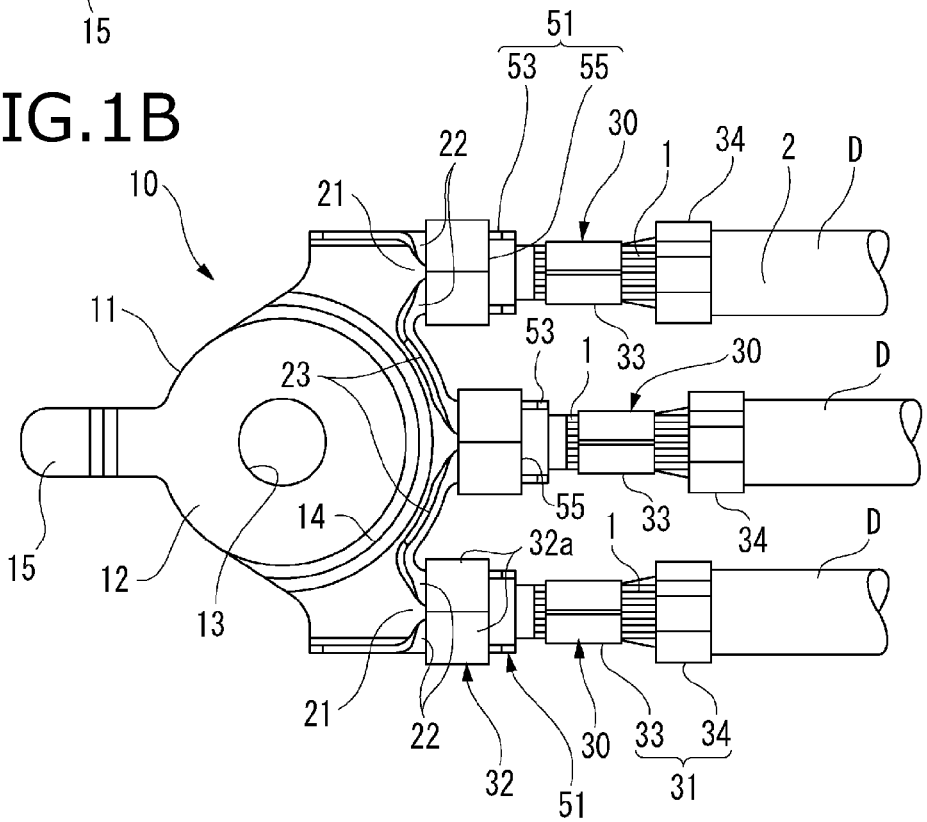

FIGS. 1A and 1B are views illustrating a connection structure of a terminal fitting 10 according to the first embodiment of the present invention; FIG. 1A is a perspective view showing the terminal fitting 10 to which grounding wires D are connected, and FIG. 1B is a plan view showing the terminal fitting 10 to which the grounding wires D are connected.

As shown in FIGS. 1A and 1B, in the connection structure of the terminal fitting according to the first embodiment, the terminal connection sections 21 of the terminal fitting 10 are connected to connection terminals 30. The terminal fitting 10 is conducted and connected to a grounding face, such as a vehicle body. The connection terminals 30 connected to the terminal fitting 10 are provided at the end sections of the grounding wires (electric wires) D of vehicle-mounted circuits (auxiliary devices). The grounding wire D has a conductor section 1 and an outer coating 2 for covering this conductor section 1, and the conductor section 1 is exposed from the outer coating 2 at the end section that is connected to the connection terminal 30. The conductor section 1 of the grounding wire D is conducted to the connection terminal 30. Hence, the grounding wires D of the vehicle-mounted circuits are conducted to the grounding face, such as a vehicle body, via the terminal fitting 10. The grounding wire D having a size of 8 $mm^2$, for example, is connected to the connection terminal 30.

Figure 2A:
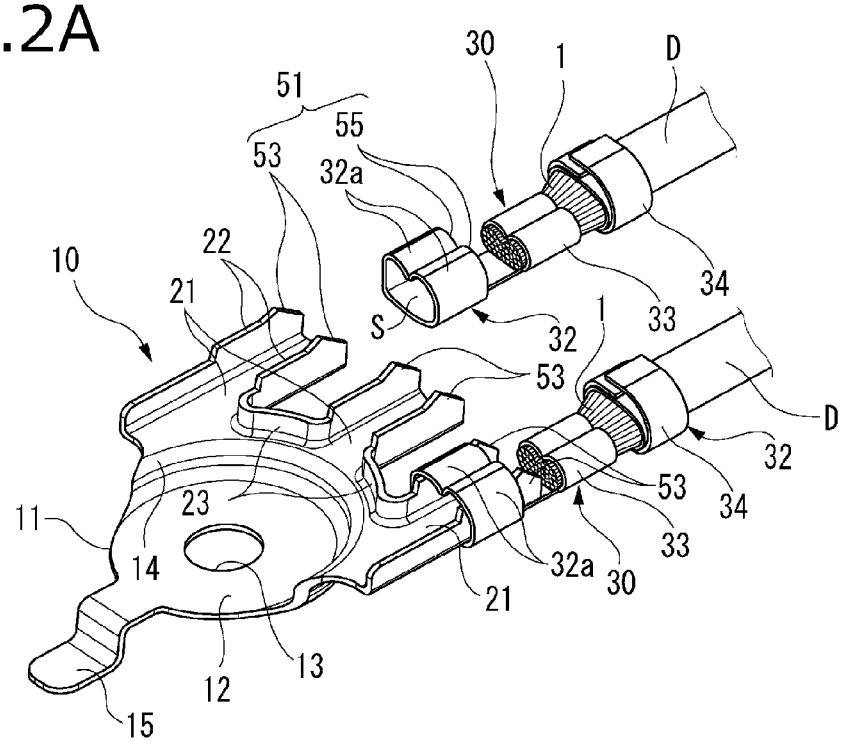
FIGS. 2A and 2B are views illustrating a provisional engaging structure of the terminal fitting and connection terminals according to the first embodiment.
Figure 2B:
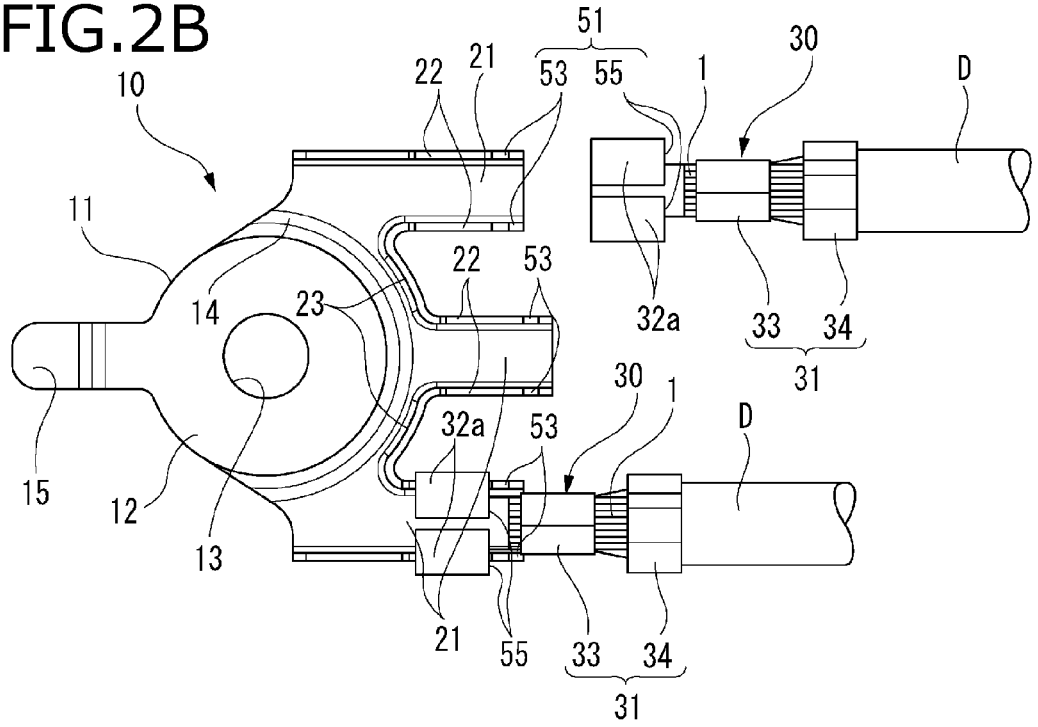

FIGS. 2A and 2B are views illustrating a provisional engaging structure of the terminal fitting according to the first embodiment; FIG. 2A is a perspective view showing the terminal fitting 10 and the connection terminals 30, and FIG. 2B is a plan view showing the terminal fitting 10 and the connection terminals 30.

As shown in FIGS. 2A and 2B, the terminal fitting 10 has a terminal body 11 and a plurality of terminal connection sections 21. The terminal fitting 10 is a press-formed product made of a metal plate having conductivity. The terminal body 11 has a fixing plate section 12 having a circular shape in a plan view. A circular mounting hole 13 is formed at the center of this fixing plate section 12. The terminal body 11 is fixed to the grounding face, such as a vehicle body, with a bolt (not shown) that is inserted into the mounting hole 13 of the fixing plate section 12. The mounting hole 13, however, is not required to be provided at the center of the fixing plate section 12, but may be provided eccentrically.

A connection plate section 14 is formed at a nearly semicircular portion of the periphery thereof. The connection plate section 14 protrudes to the upper face side thereof, that is, one of the face sides thereof. Hence, a step is formed between the fixing plate section 12 and the connection plate section 14. Besides, a rotation-stopping piece 15 is formed at the circumferentially central position of the portion other than the connection plate section 14 of the fixing plate section 12. The rotation-stopping piece 15 is a bent section to be engaged with a step or a hole provided around the grounding face to which the terminal body 11 is fastened with the bolt. The rotation of the terminal fitting 10 with respect to the grounding face is regulated by the engagement of the rotation-stopping piece 15 with the step or the hole provided around the grounding face.

The terminal connection sections 21 are integrated with the connection plate section 14 of the terminal body 11. The terminal connection sections 21 being plural in number are provided on the connection plate section 14. More specifically, the terminal connection sections 21 being three in number are formed on the connection plate section 14. These terminal connection sections 21 are extended inside the same plane from the periphery of the fixing plate section 12 in the leading-out direction of the grounding wires D respectively connected to the connection terminals 30 and are respectively disposed at intervals in the width direction thereof. The terminal connection section 21 on the central side protrudes in the extension direction further than the terminal connection sections 21 on both sides.

Engaging walls 22 serving as pair of caulked pieces and protruding to the upper face side, that is, one of the face sides of each terminal connection section 21, are provided so as to stand upright on both the side sections of the terminal connection section 21. Hence, each terminal connection section 21 is formed into a U-shape in a front view. The engaging walls 22 of the terminal connection sections 21 adjacent to each other are formed so as to continue to the peripheral wall section 23 formed on the side of the fixing plate section 12.

Figure 3:
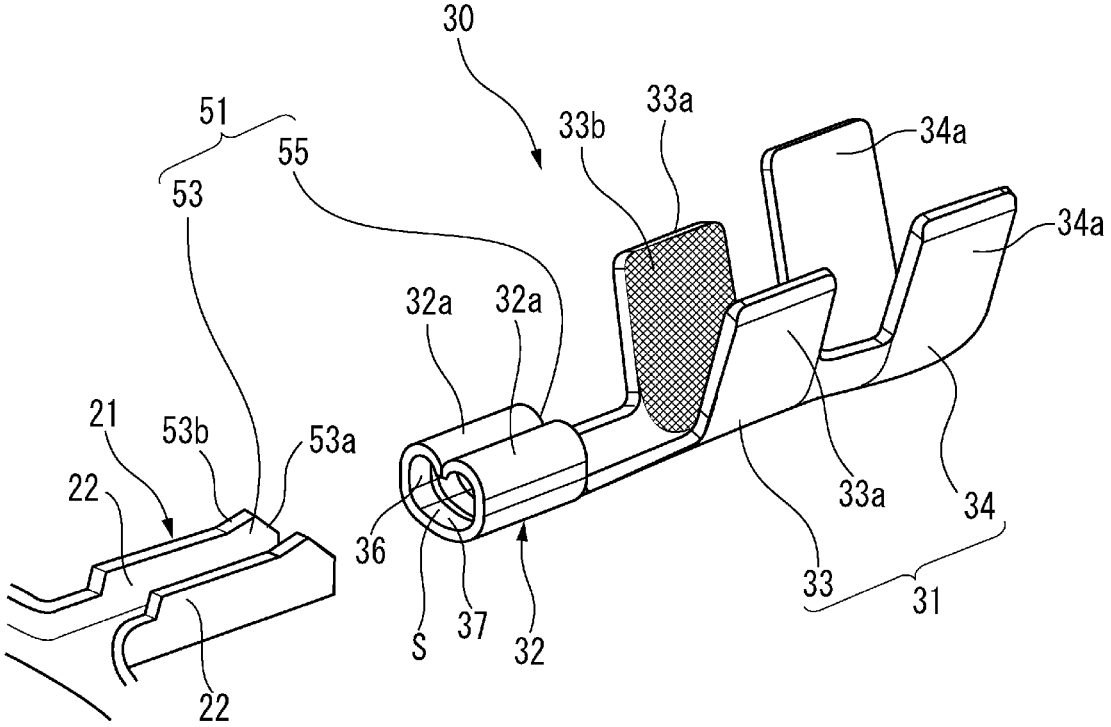
FIG. 3 is a perspective view showing the terminal connection section of the terminal fitting and the connection terminal.

Furthermore, an engaging protruding section 53 is provided so as to protrude upward at the tip end of the upper end section of the engaging wall 22 of the terminal connection section 21. This engaging protruding section 53 is a triangular protrusion having an electric wire-side tapered face 53*a* inclined to the bottom section side toward the tip end and a terminal fitting-side tapered face 53*b* inclined to the bottom section side toward the base end as shown in FIG. 3. Moreover, the engaging protruding sections 53 are combined with the electric wire-side side faces 55 of a pair of fastening caulking pieces 32*a* formed on the fastening connection section 32 of the connection terminal 30 described later to constitute a provisional engaging mechanism 51.

As shown in FIG. 3, the connection terminal 30 has a wire connection section 31 and the fastening connection section 32. The grounding wire D is connected to the wire connection section 31. The connection terminal 30 provided for the grounding wire D is a press-formed product made of a metal plate having conductivity. The fastening connection section 32 is caulked and fastened to the terminal connection section 21 of the terminal fitting 10. The wire connection section 31 has a conductor caulking section 33 and a coating caulking section 34.

The conductor caulking section 33 is formed into a U-shape having a pair of conductor caulking pieces 33*a*. The conductor section 1 of the grounding wire D is caulked and fixed to the conductor caulking section 33 by caulking the conductor caulking pieces 33*a*. Hence, the conductor section 1 of the grounding wire D is conducted to the connection terminal 30. Furthermore, a rough face section (serration) 33*b* being processed so as to be roughened is provided on the inner face of the conductor caulking section 33. However, the rough face section 33*b* is not limited to have the shape shown in the figure. With this configuration, the conductor section 1 of the grounding wire D caulked to the conductor caulking section 33 is securely conducted to the connection terminal 30.

The coating caulking section 34 is formed into a U-shape having a pair of coating caulking pieces 34*a*. The tip end portion of the outer coating 2 of the grounding wire D is caulked and fixed to the coating caulking section 34 by caulking the coating caulking pieces 34*a*.

For the connection of the grounding wire D to the connection terminal 30, the outer coating 2 is removed to expose the conductor section 1 at the end section of the grounding wire D. After that, the end section of the grounding wire D is placed on the wire connection section 31 of the connection terminal 30, the conductor caulking section 33 is caulked, and the coating caulking section 34 is caulked, whereby the grounding wire D is conducted and connected to the connection terminal 30.

The fastening connection section 32 of the connection terminal 30 has the pair of fastening caulking pieces 32*a*. The fastening caulking pieces 32*a* stand upright upward from the bottom section 37 of the connection terminal 30. Furthermore, the upper end sections of the fastening caulking pieces 32*a* are curved inward into a circular arc shape and folded back.

With this configuration, a holding space S enclosed with the fastening caulking pieces 32*a* is formed in the fastening connection section 32 of the connection terminal 30. Both the side faces of the holding space S are nearly vertical faces formed by the fastening caulking pieces 32*a* standing upright upward, and both the side faces are used as rotation regulating faces 36.

The holding space S of the fastening connection section 32 is formed so as to be slightly larger than the external size of the engaging wall 22 of the terminal connection section 21 and so as to be lower than the height of the engaging protruding section 53 in a front view. Hence, the terminal connection section 21 can be inserted into and detached from the holding space S while the fastening caulking pieces 32*a* are elastically deforming upward (see FIG. 5C and 5D). What's more, in the state in which the terminal connection section 21 is inserted in the holding space S, the terminal connection section 21 makes contact with the rotation regulating faces 36 formed of both the side faces forming the holding space S, whereby the rotation of the terminal connection section 21 around the axial line along the insertion direction of the terminal connection section 21 to the holding space S is regulated.

Furthermore, the engaging protruding sections 53 of the engaging walls 22 passing through the holding space S of the fastening connection section 32 are combined with the electric wire-side side faces 55 of the fastening caulking pieces 32*a* to constitute a provisional engaging mechanism 51. In other words, in the state in which the electric wire-side side faces 55 of the fastening caulking pieces 32*a* are engaged with the engaging protruding sections 53 having passed through the holding space S, the detachment of the terminal connection section 21 from the holding space S of the connection terminal 30 is regulated. Although the fastening caulking pieces 32*a* have a constant holding force for the engaging protruding sections 53 of the engaging walls 22, in the case that an extraction force larger than a predetermined value to the extent that the engaging protruding sections 53 are moved toward the terminal fitting while elastically deforming the fastening caulking pieces 32*a* upward is exerted to the terminal connection section 30, the connection terminal 30 is detached from the terminal connection section 21.

As described above, the terminal fitting 10 and the connection terminal 30 are equipped with the provisional engaging structure in which the engaging walls 22 of the terminal connection section 21 and the fastening caulking pieces 32*a* are set to a provisional engaging state so as to be detachably engaged by the provisional engaging mechanism 51.

As described above, with the provisional engaging structure of the terminal fitting 10 and the connection terminal 30 according to the first embodiment, before the connection terminal 30 is caulked and fastened to the terminal fitting 10, the engaging walls 22 of the terminal connection section 21 of the terminal fitting 10 and the fastening caulking pieces 32*a* of the connection terminal 30 are set to the provisional engaging state so as to be detachably engaged by the provisional engaging mechanism 51.

Hence, a harness in which the terminal fitting 10 and the plurality of connection terminals 30 are set to the provisional engaging state can be moved between processing steps, and the connection terminals 30 can be caulked and fastened to the terminal fitting 10 in a later processing step, whereby the degree of freedom of harness assembling work increases. Furthermore, since the terminal fitting 10 and the plurality of connection terminals 30 being set to the provisional engaging state are detachably engaged, in the case that misconnection is found between the terminal fitting 10 and the connection terminals 30 by a continuity check in the provisional engaging state, circuit correction can be made easy.

Moreover, with the connection structure of the terminal fitting 10 according to the first embodiment, when the terminal fitting 10 is connected to a plurality of electric wires D via the connection terminals 30, the reliability of the electrical connection therebetween is maintained by caulking and fastening.

What's more, when the fastening caulking pieces 32*a* are caulked to the engaging walls 22, since the engaging walls 22 and the fastening caulking pieces 32*a* are set to the provisional engaging state, defects caused by fluctuations in crimping strength due to positional displacement or the like during caulking can be suppressed. Still further, since the engaging walls 22 and the fastening caulking pieces 32*a* are set to the provisional engaging state, the plurality of connection terminals 30 can be caulked and fixed to the terminal fitting 10 simultaneously.

As a result, the plurality of electric wires D can be conducted and connected to the terminal fitting 10 collectively by caulking and fastening the connection terminals 30 to the terminal fitting 10. Hence, the terminal fitting 10 is not required to be stacked in comparison with the conventional structure in which the terminal fittings connected to the respective electric wires D are stacked, fastened and conducted, whereby, even if the number of the electric wires D increases, the increase in the weight of the terminal fitting can be suppressed. Furthermore, since the terminal fitting 10 is not required to be stacked, even if the number of the electric wires D to be conducted and connected increases, the thickness of the terminal fitting 10 does not increase, whereby space saving is attained. Furthermore, fastening work to be performed after bolt/nut length adjustment associated with the stacking of the terminal fittings has been completed is not required, whereby working time can be shortened.

In addition, since the structure of the terminal fitting 10 is configured such that the connection terminals 30 separated from the terminal fitting 10 are caulked, fastened and connected to the terminal fitting 10, the connection terminals 30 to which the electric wires D having different sizes in diameter are connected can be caulked, fastened and conducted to the terminal connection sections 21. In other words, the electric wires D having various sizes can be connected without changing the connection configuration between the terminal connection sections 21 of the terminal fitting 10 and the fastening connection sections 32 of the connection terminals 30. Furthermore, the increase/decrease in the number of the electric wires D to be conducted can be easily dealt with by preparing the terminal fittings 10 being different in the number of the terminal connection sections 21. As a result, the terminal fittings 10 having minimum necessary variation can be used to deal with the changes in the number and size of the electric wires D to be conducted.

Moreover, since the structure of the terminal fitting 10 is configured such that the connection terminals 30 are fastened to the plurality of terminal connection sections 21 of the terminal fitting 10, the connection terminals 30 can be caulked and fastened to the terminal connection sections 21 as necessary, whereby the number of the electric wires D to be conducted collectively can be increased/decreased easily within the range of the number of the terminal connection sections 21.

What's more, the terminal connection sections 21 are extended inside the same plane in the leading-out direction of the grounding wires D respectively connected to the connection terminals 30 and are disposed mutually at intervals. Hence, the connection directions of the connection terminals 30 and the wiring directions of the grounding wires D with respect to the terminal fitting 10 can be aligned to the same direction, whereby the workability of fastening the connection terminals 30 to the terminal connection sections 21 of the terminal fitting 10 can be improved. Still further, the wiring directions of the grounding wires D can be aligned to the same direction along the flow of the trunk line, and unnecessary spreading of the grounding wires D and bending of the grounding wires D in the vicinity of the connection terminals 30 can be suppressed as much as possible.

Next, the provisional engaging method of the terminal fitting and connection terminals and the connection method of the terminal fitting according to the first embodiment will be described (holding space demarcating step).

Figure 5A:
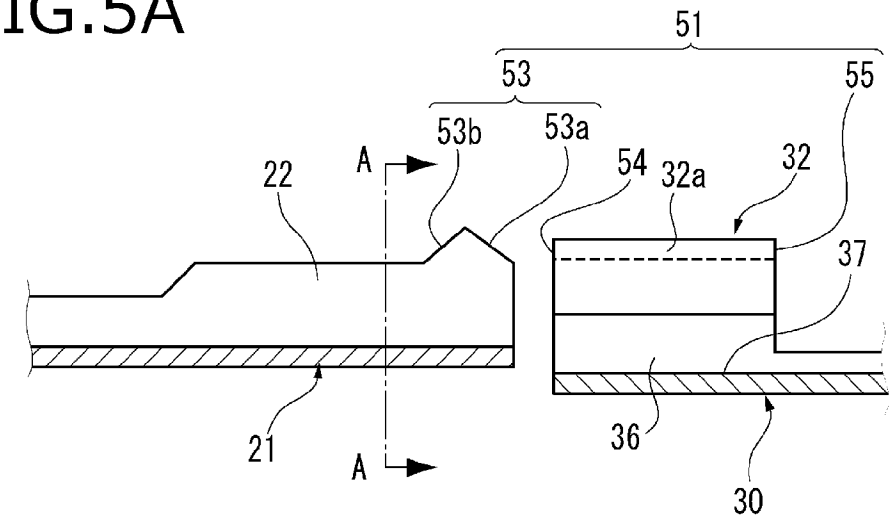
FIGS. 5A to 5D are main part cross-sectional views illustrating a provisional engaging method of the terminal fitting and the connection terminal and a connection method of the terminal fitting according to the first embodiment.
Figure 5B:
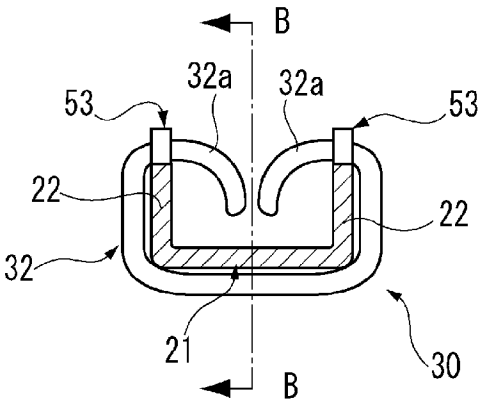

First, as shown in FIG. 3 and FIGS. 5A and 5B, the upper end sections of the pair of fastening caulking pieces 32*a* provided so as to stand upright at both the side sections of the connection terminal 30 are respectively folded back inward, whereby the holding space S capable of accommodating the pair of engaging walls 22 is demarcated in the connection terminal 30.

(Provisional Engaging Step)

Next, the engaging walls 22 of the terminal connection section 21 are inserted into the holding space S, whereby the pair of fastening caulking pieces 32*a* is detachably engaged with the pair of engaging walls 22 by the provisional engaging mechanism 51 provided between the terminal connection section 21 and the connection terminal 30. More specifically, as shown in FIGS. 5C and 5D and FIGS. 6A and 6B, the terminal connection section 21 is inserted into the holding space S of the connection terminal 30, and the engaging protruding sections 53 of the engaging walls 22 are passed through the holding space S.

Figure 5C:
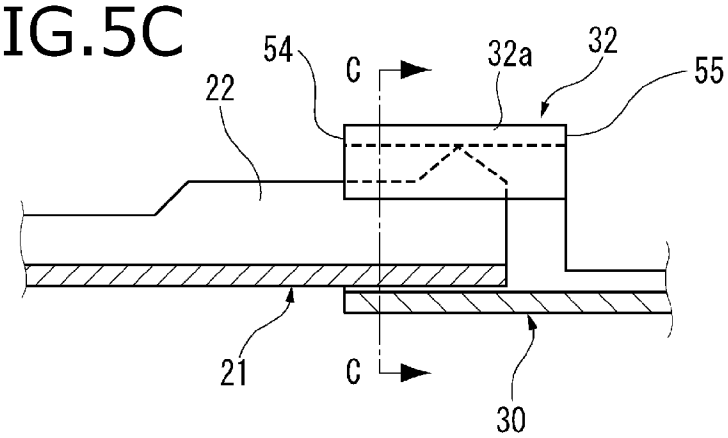
Figure 5D:
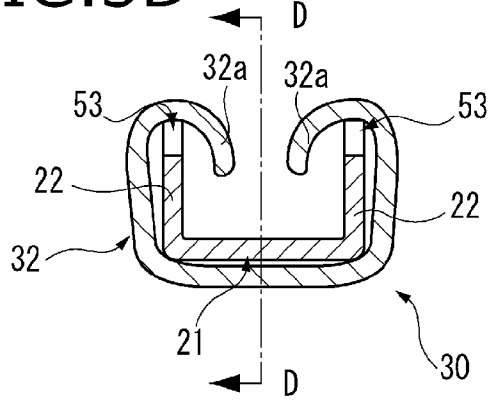

At this time, since the holding space S is formed so as to be lower than the height of the engaging protruding sections 53, when the terminal connection section 21 is attempted to be inserted into the holding space S, the engaging protruding sections 53 make contact with the terminal fitting-side side faces 54 of the fastening caulking pieces 32*a*. Since the electric wire-side tapered faces 53*a* are formed on the engaging protruding sections 53, when the terminal connection section 21 is strongly pushed into the holding space S, the engaging protruding sections 53 enter the holding space S while elastically deforming the fastening caulking pieces 32*a* upward and then reach the electric wire-side side faces 55 of the fastening caulking pieces 32*a* as shown in FIGS. 5C and 5D.

Figure 6A:
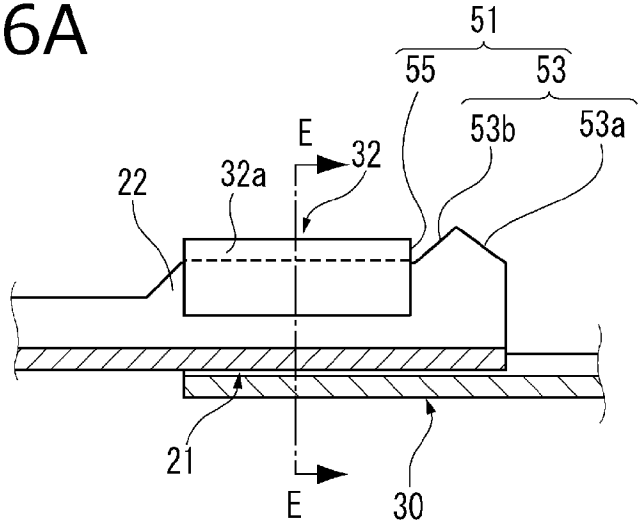
FIGS. 6A to 6D are main part cross-sectional views illustrating the provisional engaging method of the terminal fitting and the connection terminal and the connection method of the terminal fitting according to the first embodiment.
Figure 6B:
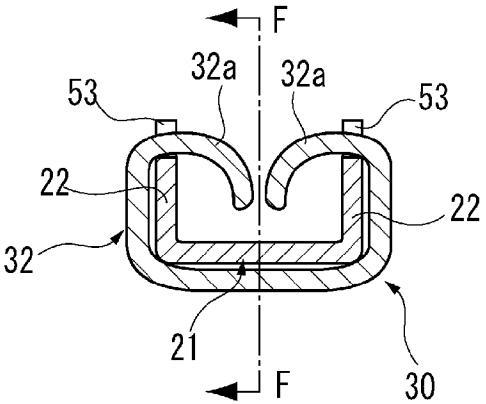

When the engaging protruding sections 53 reach the electric wire-side side faces 55, the fastening caulking pieces 32*a* elastically return downward as shown in FIGS. 6A and 6B. Hence, the electric wire-side side faces 55 of the fastening caulking pieces 32*a* make contact with the engaging protruding sections 53 having passed through the holding space S, whereby engagement is performed therebetween and the terminal connection section 21 is regulated from being detached from the holding space S of the connection terminal 30. Furthermore, when the terminal connection section 21 is inserted into the holding space S, both the side sections of the terminal connection section 21 make contact with the rotation regulating faces 36 formed of both the side faces forming the holding space S, whereby the terminal connection section 21 is held by the fastening connection section 32 of the connection terminal 30 in a state in which the rotation of the terminal connection section 21 around the axial line along the insertion direction thereof is regulated. As a result, the terminal connection section 21 is maintained in a predetermined posture at a predetermined position with respect to the connection terminal 30.

At this time, although the fastening caulking pieces 32*a* have a constant holding force for the engaging protruding sections 53 of the engaging walls 22 that is attempted to be detached, in the case that an extracting force larger than a predetermined value to the extent that the terminal fitting-side tapered faces 53*b* of the engaging protruding sections 53 are moved toward the terminal fitting while elastically deforming the fastening caulking pieces 32*a* upward is exerted to the terminal connection section 30, the connection terminal 30 is detached from the terminal connection section 21.

As described above, the engaging walls 22 of the terminal connection section 21 of the terminal fitting 10 and the fastening caulking pieces 32*a* of the connection terminal 30 are set to a provisional engaging state so as to be detachably engaged by the provisional engaging mechanism 51.

Figure 4:
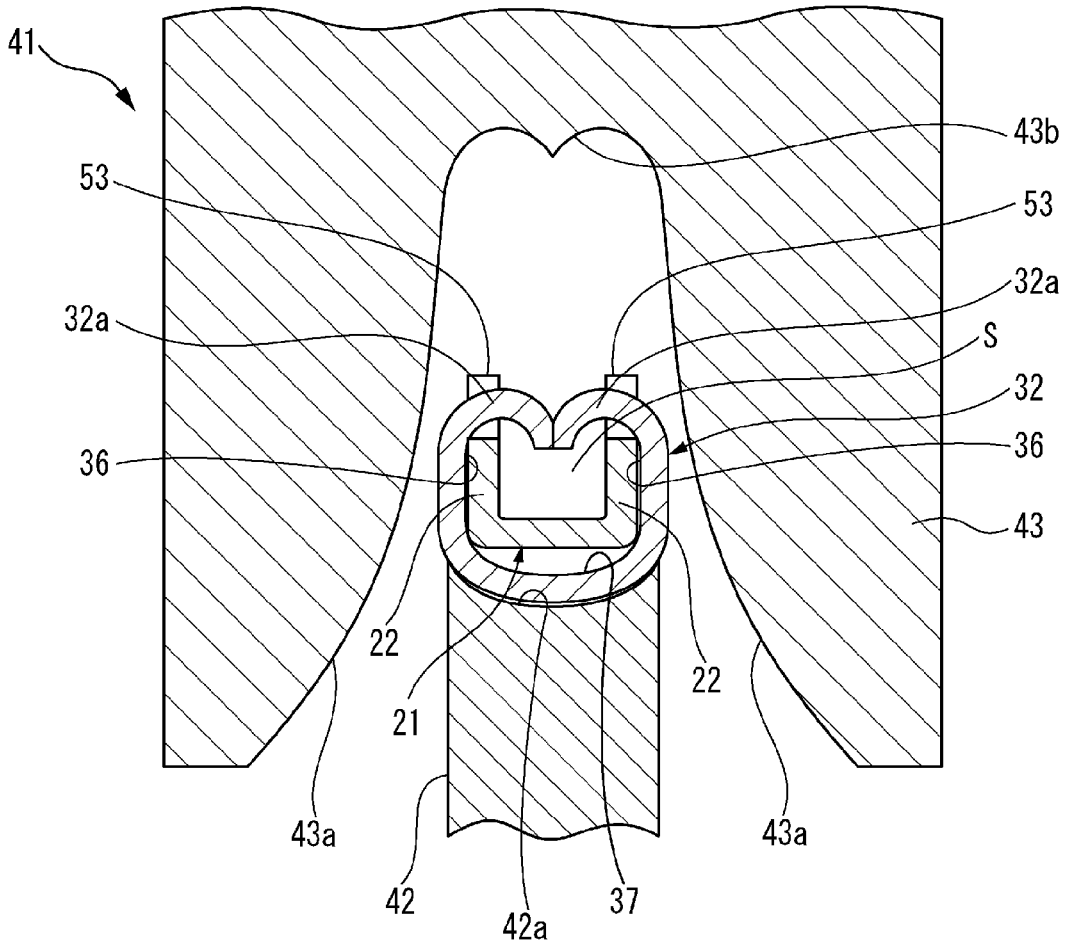
FIG. 4 is a schematic cross-sectional view showing a crimping machine in which the connection terminal and the terminal connection section are set.

As shown in FIG. 4, the crimping machine 41 for crimping the connection terminal 30 to the terminal connection section 21 so as to caulk and fasten the terminal has an anvil 42 and a crimper 43 that is configured so as to be able to approach the anvil 42 and to be separated therefrom. The upper face of the anvil 42 is used as a mounting face 42*a*, and the connection terminal 30 is mounted on the mounting face 42*a*. The mounting face 42*a* is formed into a circular arc shape slightly recessed downward. Hence, the connection terminal 30 mounted on the mounting face 42*a* is disposed on the anvil 42. The crimper 43 is formed into a concave shape having guide faces 43*a* gradually expanding toward the anvil 42. At the upper section of the concave portion, the crimper 43 has pressing faces 43*b* for respectively pressing the fastening caulking pieces 32*a* while guiding them inward.

Hence, as shown in FIG. 4, the connection terminal 30 to which the terminal connection section 21 is provisionally engaged is mounted on the mounting face 42*a* of the anvil 42. Also in this state, since the terminal connection section 21 has been inserted into the holding space S and provisionally engaged by the provisional engaging mechanism 51, the rotation thereof around the axial line along the insertion direction and the movement thereof in the detaching direction are regulated, whereby the terminal connection section 21 is maintained in the predetermined posture and the predetermined position with respect to the connection terminal 30.

(Caulking Step)

The crimping machine 41 is operated to start crimping, and the crimper 43 of the crimping machine 41 is lowered. The fastening connection section 32 is then guided to the concave portion by the guide faces 43*a* of the crimper 43. Also at this time, the terminal connection section 21 is maintained in the predetermined posture and the predetermined position with respect to the connection terminal 30 inside the holding space S. After that, the pressing faces 43*b* of the crimper 43 make contact with the upper sections of the fastening caulking pieces 32*a* of the fastening connection section 32, whereby the fastening caulking pieces 32*a* are crushed and caulking is started.

The fastening caulking pieces 32*a* then enfold both the side sections of the terminal connection section 21. After that, the fastening caulking pieces 32*a* are caulked so as to enfold the engaging walls 22 of the terminal connection section 21 from the outside.

Figure 6C:
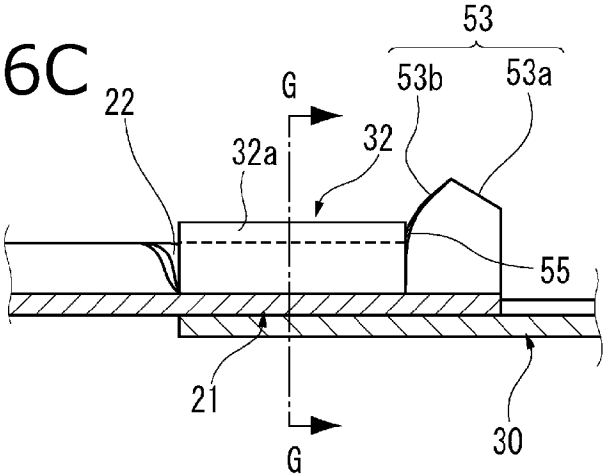
Figure 6D:
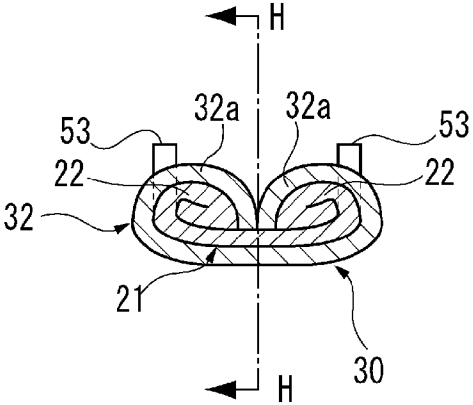

As a result, as shown in FIGS. 6C and 6D, the engaging walls 22 are rounded and accommodated inside the fastening caulking pieces 32*a* without clearance, and the inside of the fastening connection section 32 is in a state of being filled with the terminal connection section 21. Consequently, the fastening connection section 32 is strongly caulked and fastened to the terminal connection section 21 with high contact pressure, and the terminal fitting 10 is securely conducted to the connection terminal 30.

Furthermore, since the engaging protruding sections 53 of the terminal connection section 21 are provided so as to protrude to the tip ends of the upper end sections of the engaging walls 22 without being caulked, the terminal connection section 21 is prevented from being extracted from the fastening caulking pieces 32*a*. In other words, since the fastening connection section 32 is caulked and fastened to the terminal connection section 21, the fastening caulking pieces 32*a* cannot be elastically deformed upward with respect to the bottom section 37 of the connection terminal 30. Hence, the terminal connection section 21 provided with the engaging protruding sections 53 that cannot be detached from the fastening caulking pieces 32*a* is strongly prevented from being extracted from the fastening connection section 32.

When the respective terminal connection sections 21 of the terminal fitting 10 are fastened and connected to the connection terminals 30 by the above-mentioned step, the plurality of grounding wires D is collectively conducted to the terminal fitting 10. The terminal fitting 10 is then fixed to the grounding face of the vehicle with the bolt, whereby the plurality of grounding wires D is grounded.

As described above, with the provisional engaging method of the terminal fitting 10 and the connection terminals 30 according to the first embodiment, before each of the connection terminals 30 is caulked and fastened to the terminal fitting 10, the engaging walls 22 of the terminal connection section 21 of the terminal fitting 10 and the fastening caulking pieces 32*a* of the connection terminal 30 can be set to a provisional engaging state so as to be detachably engaged by the provisional engaging mechanism 51.

Hence, a harness in which the terminal fitting 10 and the plurality of connection terminals 30 are set to the provisional engaging state can be moved between processing steps, and the connection terminals 30 can be caulked and fastened to the terminal fitting 10 in a later processing step, whereby the degree of freedom of harness assembling work increases. Furthermore, since the terminal fitting 10 and the plurality of connection terminals 30 being set to the provisional engaging state are detachably engaged, in the case that misconnection is found between the terminal fitting 10 and the connection terminals 30 by a continuity check in the provisional engaging state, circuit correction can be made easy.

In addition, with the connection method of the terminal fitting according to the first embodiment, the terminal connection section 21 is inserted and provisionally engaged in the holding space S that is preliminarily formed in the connection terminal 30, and the fastening caulking pieces 32*a* are crushed so as to be caulked and fastened to the pair of engaging walls 22 formed on the terminal connection section 21 inserted in the holding space S, whereby the caulking fastening work can be performed in a state in which the posture of the terminal connection section 21 with respect to the connection terminal 30 is made stable.

Hence, defects caused by fluctuations in crimping strength due to positional displacement or the like during caulking can be suppressed. Still further, since the engaging walls 22 and the fastening caulking pieces 32*a* are set to the provisional engaging state, the plurality of connection terminals 30 can be caulked and fixed to the terminal fitting 10 simultaneously in the caulking step. As a result, the plurality of electric wires D can be conducted and connected to the terminal fitting 10 collectively by caulking and fastening the connection terminals 30 to the terminal fitting 10.

Furthermore, the engaging protruding sections 53 that are provided on the engaging walls 22 to serve as the provisional engaging mechanism 51 so that the terminal fitting 10 and the plurality of connection terminals 30 are provisionally engaged can be easily formed by press working or the like, whereby the increase in processing cost can be suppressed.

However, although the engaging protruding sections 53 making contact with the electric wire-side side faces 55 of the fastening caulking pieces 32*a* are provided so as to protrude at the tip ends of the upper end sections of the engaging walls 22 of the terminal connection section 21 and so as to serve as the provisional engaging mechanism 51 in the first embodiment described above, the provisional engaging mechanism is not limited to have the above-mentioned structure.

Figure 7A:
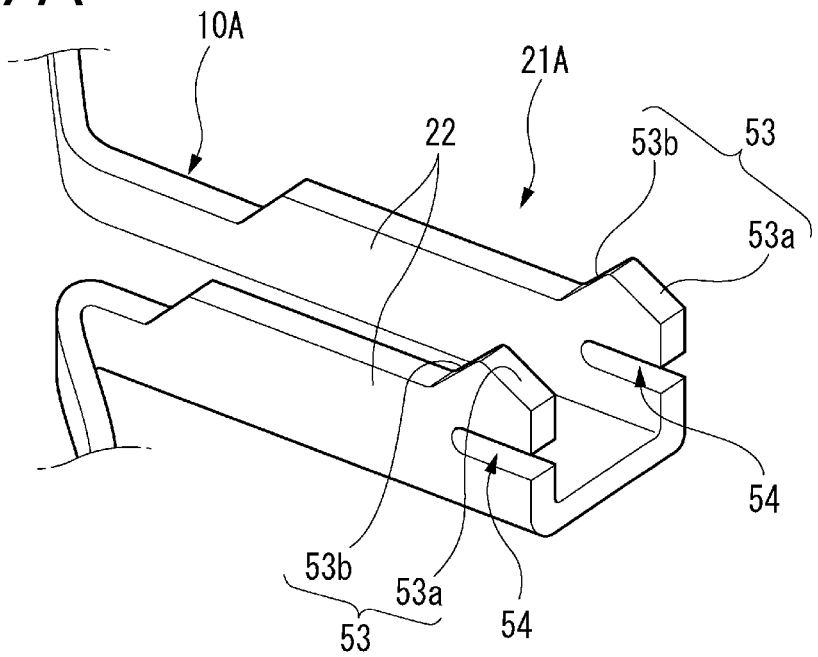
FIGS. 7A and 7B are main part enlarged perspective views showing a modification of the terminal connection section of the terminal fitting according to the first embodiment.

For example, as shown in FIG. 7A, a provisional engaging mechanism may be configured such that flexibly deformable engaging arms are formed by forming cut-out portions 54 at the tip ends of the engaging arms 22 of the terminal connection section 21A of a terminal fitting 10A and such that the engaging protruding sections 53 provided so as to protrude at the tip ends of the upper end sections of the engaging walls 22 can be displaced in the disengaging direction (downward in the figure) thereof. The insertion force to be exerted at the time when the engaging walls 22 are inserted into the holding space S of the fastening connection section 32 can be reduced by providing the engaging protruding sections 53 on the rocking end sides of the engaging arms.

Moreover, the inclination angles of the electric wire-side tapered face 53*a* and the terminal fitting-side tapered face 53*b* of the engaging protruding section 53 can be changed as necessary, whereby the insertion force and the extraction force of the engaging protruding section 53 can be set individually and freely. The shape of the engaging protruding section 53 according to the present invention is not limited to a triangular shape, but the engaging protruding section 53 can have various shapes, such as a semicircular shape and a trapezoidal shape, as a matter of course.

Figure 7B:
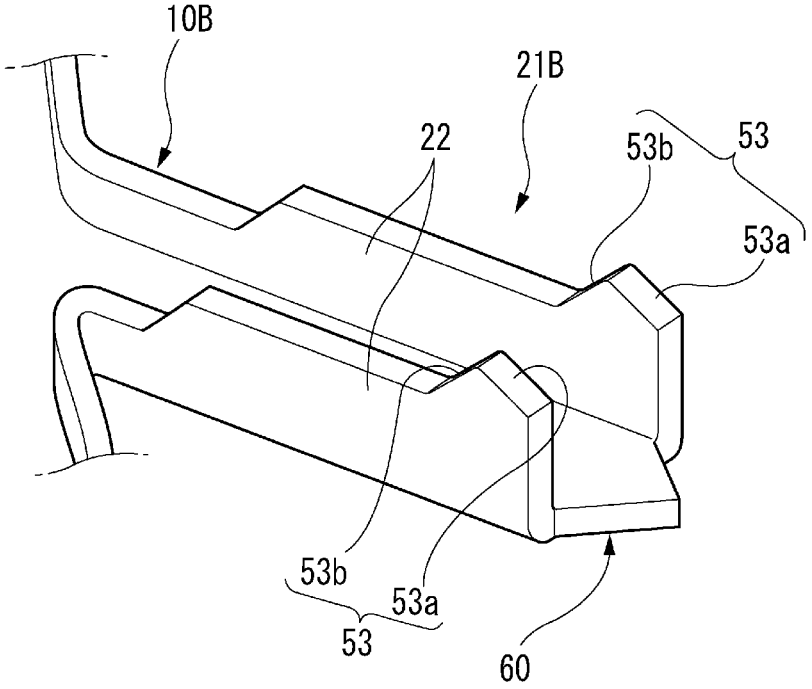

Besides, as shown in FIG. 7B, an insertion guide 60 having a narrow tip end to be inserted and guided at the time when the terminal connection section 21B of a terminal fitting 10B is inserted into the holding space S of the fastening connection section 32 may be provided at the tip end section of the bottom section of the terminal connection section 21B. Since the insertion guide 60 is formed at the tip end section of the terminal connection section 21B as described above, the insertion property of the terminal connection section 21B at the time when the engaging walls 22 are inserted into the holding space S can be improved. The shape of the insertion guide 60 is not limited to the triangular shape shown in the figure, but the insertion guide 60 can have various shapes, such as a semicircular shape and a semi-oval shape.

Furthermore, although the terminal fitting 10 having the three terminal connection sections 21 has been taken as an example and explained in the first embodiment described above, the number of the terminal connection sections 21 of the terminal fitting 10 may be plural; the number is not limited to three but may be four or more.

Moreover, in the first embodiment described above, the grounding wires D of the vehicle-mounted circuits (auxiliary devices) are connected to the terminal fitting 10, whereby the grounding wires D are collectively grounded. However, electric wires to be connected to the terminal fitting 10 are not limited to grounding wires.

What's more, instead of providing the rotation-stopping piece 15 on the terminal body 11 of the terminal fitting 10, a step or a rotation-stopping piece that makes contact with the terminal fitting 10 to stop the rotation thereof at the time when the terminal fitting 10 is mounted on a grounding face may be provided on the side of the grounding face.

Still further, although in the first embodiment described above, the plurality of terminal connection sections 21 is extended inside the same plane from the periphery of the fixing plate section 12 in the leading-out direction of the grounding wires D respectively connected to the connection terminals 30 in the first embodiment described above, the terminal connection sections according to the present invention may be extended radially inside the same plane from the periphery of the fixing plate section.

Next, a provisional engaging structure of a terminal fitting and connection terminals according to a second embodiment of the present invention will be described below. The components similar to those of the terminal fitting 10 and the connection terminals 30 according to the first embodiment described above are designated by the same numerals, and their detailed descriptions are omitted.

Figure 8:
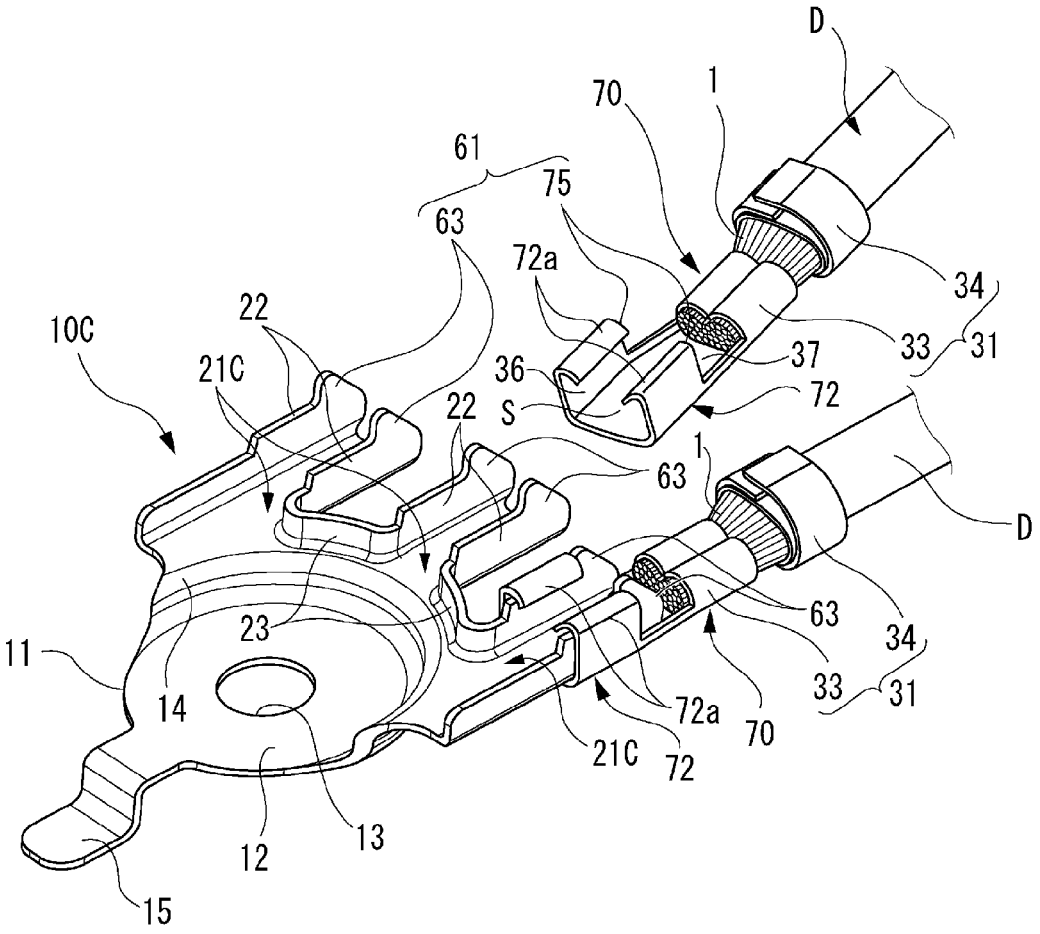
FIG. 8 is a view illustrating a provisional engaging structure of a terminal fitting and connection terminals according to a second embodiment of the present invention.
Figure 9A:
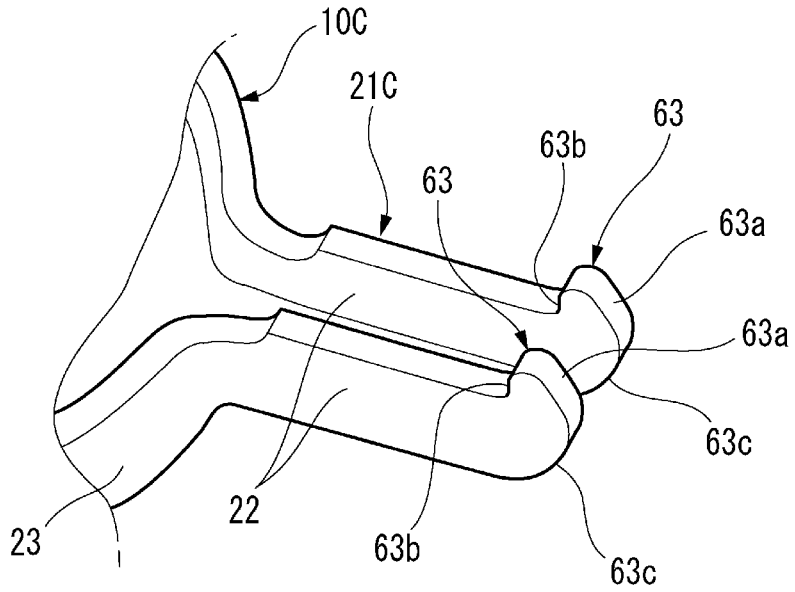
FIG. 9A is an enlarged perspective view showing a terminal connection section, and 9B is a main part perspective view showing the connection terminal provisional engaged with the terminal connection section.

FIG. 8 is a perspective view illustrating a provisional engaging structure of a terminal fitting 10C and connection terminals 70 according to the second embodiment of the present invention. FIG. 9A is an enlarged perspective view showing a terminal connection section 21C, and FIG. 9B is a main part perspective view showing the connection terminal 70 provisionally engaged with the terminal connection section 21C.

Figure 9B:
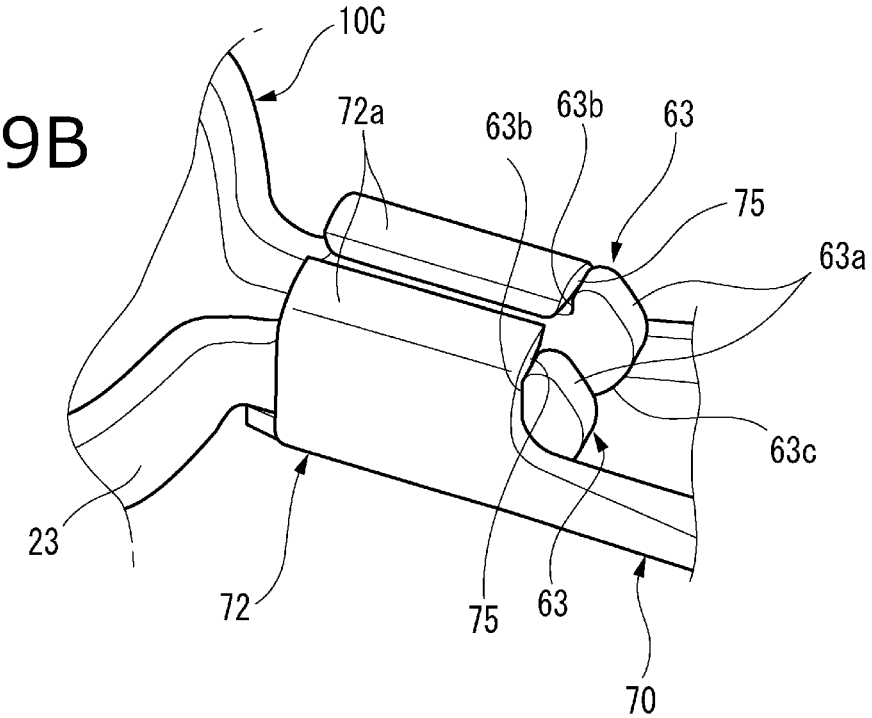

As shown in FIG. 8 and FIGS. 9A and 9B, the terminal fitting 10C according to the second embodiment has the terminal body 11 and the plurality of terminal connection sections 21C. The terminal fitting 10C is a press-formed product made of a metal plate having conductivity.

The terminal connection sections 21C are integrated with the connection plate section 14 of the terminal body 11. The terminal connection sections 21C being plural in number are provided on the connection plate section 14. More specifically, the terminal connection sections 21C being three in number are formed on the connection plate section 14. These terminal connection sections 21C are extended inside the same plane from the periphery of the fixing plate section 12 in the leading-out direction of the grounding wires D respectively connected to the connection terminals 70 and are respectively disposed at intervals in the width direction thereof. The terminal connection section 21C on the central side protrudes in the extension direction further than the terminal connection sections 21C on both sides.

The engaging walls 22 serving as pair of caulked pieces and protruding to the upper face side, that is, one of the face sides of each terminal connection section 21C, are provided so as to stand upright on both the side sections of the terminal connection section 21C. Hence, each terminal connection section 21C is formed into a U-shape in a front view.

Furthermore, an engaging protruding section 63 is provided so as to protrude upward at the tip end section of the upper end section of the engaging wall 22 of the terminal connection section 21C. This engaging protruding section 63 is a triangular protrusion having an electric wire-side tapered face 63*a* inclined to the bottom section side toward the tip end and a terminal fitting-side engaging face 63*b* standing upright nearly vertically on the base end side as shown in FIG. 9A. Moreover, at the tip end section on the bottom section side of the engaging wall 22, a relief section 63*c* is formed by cutting out the tip end section to avoid interference at the time when the tip end section of the terminal connection section 21C is inserted into the holding space S obliquely (see FIG. 10A).

Moreover, the engaging protruding sections 63 and the relief sections 63*c* are combined with the electric wire-side side faces 75 of a pair of fastening caulking pieces 72*a* formed on the fastening connection section 72 of a connection terminal 70 described later to constitute a provisional engaging mechanism 61.

As shown in FIG. 8, the connection terminal 70 has the wire connection section 31 and the fastening connection section 72. The connection terminal 70 provided for the grounding wire D is a press-formed product made of a metal plate having conductivity. The fastening connection section 72 is caulked and fastened to the terminal connection section 21C of the terminal fitting 10C.

The fastening connection section 72 of the connection terminal 70 has the pair of fastening caulking pieces 72*a*. The fastening caulking pieces 72*a* stand upright upward from the bottom section 37 of the connection terminal 70. Furthermore, the upper end sections of the fastening caulking pieces 72*a* are curved inward into a circular arc shape and folded back.

With this configuration, the holding space S enclosed with the fastening caulking pieces 72*a* is formed in the fastening connection section 72 of the connection terminal 70. Both the side faces of the holding space S are nearly vertical faces formed by the fastening caulking pieces 72*a* standing upright upward, and both the side faces are used as the rotation regulating faces 36.

Figure 10A:
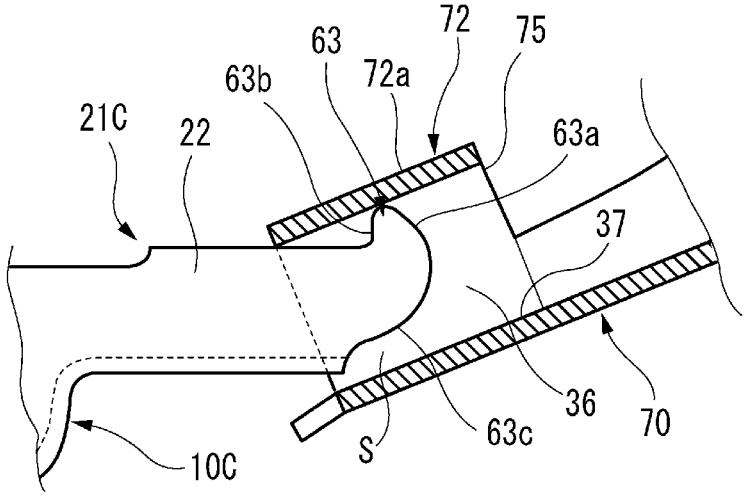
FIGS. 10A and 10B are main part cross-sectional views illustrating a temporarily engaging method of the terminal fitting and the connection terminal according to the second embodiment.

The holding space S of the fastening connection section 72 is formed so as to be slightly larger than the external size of the engaging wall 22 of the terminal connection section 21C and so as to be lower than the height of the engaging protruding section 63 in a front view. Moreover, at the tip end section on the bottom section side of the engaging wall 22, the relief section 63*c* is formed by cutting out the tip end section to avoid interference at the time when the tip end section of the terminal connection section 21C is inserted into the holding space S obliquely as shown in FIG. 10A.

With this configuration, the tip end section of the terminal connection section 21C can be inserted into and detached from the holding space S while being rotated (rocked) obliquely along the insertion direction.

Figure 10B:
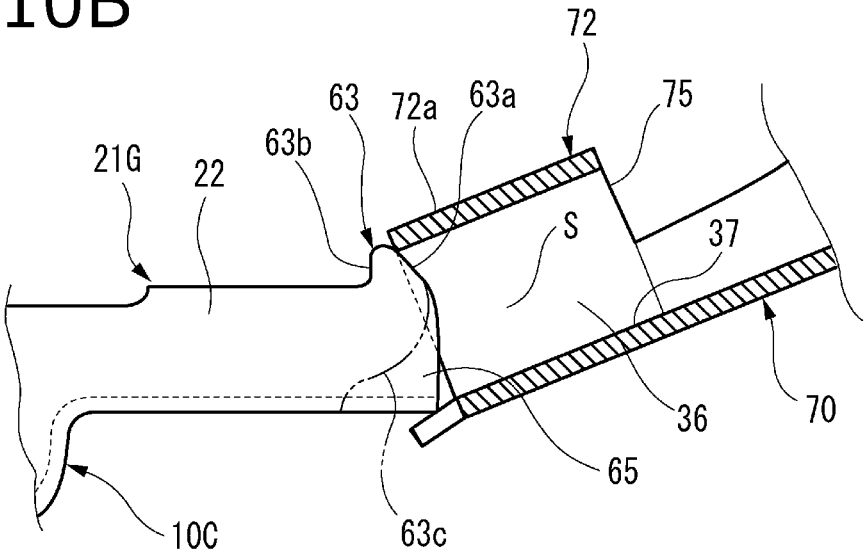

In other words, in the case that the tip end section 65 on the bottom section side of the engaging wall 22 is not cut out and the relief section 63*c* is not formed as in the terminal connection section 21G of a terminal fitting according to the reference example shown in FIG. 10B, interference occurs at the time when the tip end section of the terminal connection section 21G is inserted into the holding space S obliquely, whereby it is difficult to insert the tip end section. In the case that the tip end section is attempted to be forcibly inserted, a large insertion force is required.

Figure 11A:
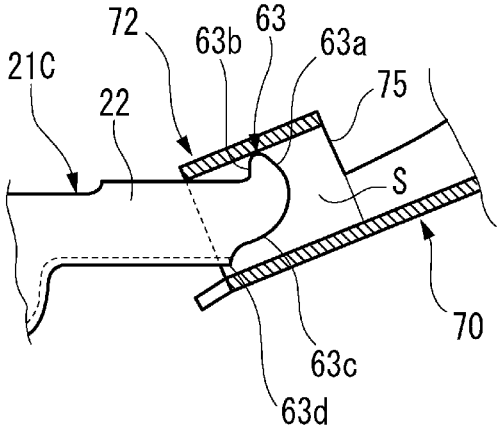
FIGS. 11A to 11C are main part cross-sectional views illustrating the steps of the provisional engaging method of the terminal fitting and the connection terminal according to the second embodiment.
Figure 11B:
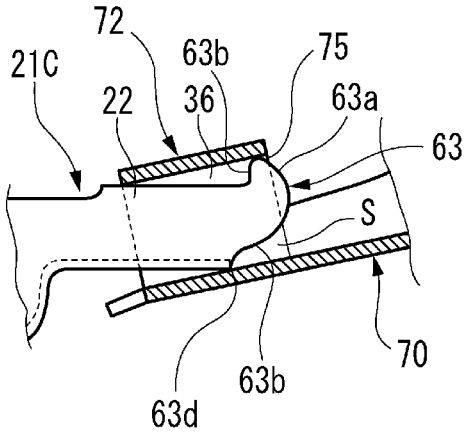

As shown in FIGS. 11A and 11B, in the case of the terminal connection section 21C, when tip end section thereof is inserted into the holding space S obliquely, the upper end sections, the engaging protruding sections 63 and the bottom section-side tip ends 63*d* of the engaging walls 22 make slide contact with the inner wall of the fastening connection section 72, whereby the tip end section is inserted into the holding space S while being rotated along the insertion direction.

Figure 11C:
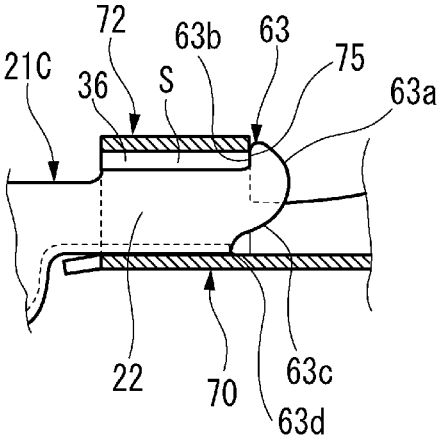

After that, when the engaging protruding sections 63 of the engaging walls 22 pass through the holding space S as shown in FIG. 11C, the electric wire-side side faces 75 of the fastening caulking pieces 72*a* make contact with the engaging protruding sections 63 having passed through the holding space S, whereby engagement is performed therebetween and the terminal connection section 21C is regulated from being detached from the holding space S of the connection terminal 70. Furthermore, when the terminal connection section 21C is inserted into the holding space S, both the side sections of the terminal connection section 21C make contact with the rotation regulating faces 36 formed of both the side faces forming the holding space S, whereby the terminal connection section 21C is held by the fastening connection section 72 of the connection terminal 70 in a state in which the rotation of the terminal connection section 21C around the axial line along the insertion direction thereof is regulated. As a result, the terminal connection section 21C is maintained in a predetermined posture at a predetermined position with respect to the connection terminal 70.

Furthermore, the engaging protruding sections 63 of the engaging walls 22 passing through the holding space S of the fastening connection section 72 are combined with the electric wire-side side faces 75 of the fastening caulking pieces 72*a* to constitute a provisional engaging mechanism 61. In other words, in a state in which the electric wire-side side faces 75 of the fastening caulking pieces 72*a* are engaged with the terminal fitting-side engaging faces 63*b* of the engaging protruding sections 63 having passed through the holding space S, the detachment of the terminal connection section 21C from the holding space S of the connection terminal 70 along the axial line of the terminal connection section 21C is regulated.

Although the fastening caulking pieces 72*a* engaged with the terminal fitting-side engaging faces 63*b* of the engaging protruding sections 63 have a constant holding force for the engaging protruding sections 63 of the engaging walls 22 in the axial line direction of the terminal connection section 21C, in the case that an extraction force larger than a predetermined value to the extent that the base end section of the terminal connection section 21C is moved toward the terminal fitting while being rotated obliquely with respect to the holding space S along the direction opposed to the insertion direction is exerted to the connection terminal 70, the connection terminal 70 is detached from the terminal connection section 21C.

As described above, the terminal fitting 10C and the connection terminal 70 are equipped with a provisional engaging structure in which the engaging walls 22 of the terminal connection section 21C and the fastening caulking pieces 72*a* are set to a provisional engaging state so as to be detachably engaged by the provisional engaging mechanism 61.

As described above, with the provisional engaging structure of the terminal fitting 10C and the connection terminal 70 according to the second embodiment, before the connection terminal 70 is caulked and fastened to the terminal fitting 10C, the engaging walls 22 of the terminal connection section 21C of the terminal fitting 10C and the fastening caulking pieces 72*a* of the connection terminal 70 are set to the provisional engaging state so as to be detachably engaged by the provisional engaging mechanism 61.

Hence, as in the case of the provisional engaging structure of the terminal fitting 10 and the connection terminal 30 according to the second embodiment, a harness in which the terminal fitting 10C and the plurality of connection terminals 70 are set to the provisional engaging state can be moved between processing steps, and the connection terminals 70 can be caulked and fastened to the terminal fitting 10C in a later processing step, whereby the degree of freedom of harness assembling work increases. Furthermore, since the terminal fitting 10C and the plurality of connection terminals 70 being set to the provisional engaging state are detachably engaged, in the case that misconnection is found between the terminal fitting 10C and the connection terminals 70 by a continuity check in the provisional engaging state, circuit correction can be made easy.

Hence, with the provisional engaging structure of the terminal fitting 10C and the connection terminal 70 according to the second embodiment having the provisional engaging mechanism 61, the tip end section of the terminal connection section 21C in which the engaging protruding sections 63 are provided so as to protrude and the relief sections 63*c* are formed on the bottom section sides of the engaging walls 22 is inserted into the holding space S of the connection terminal 70 along the insertion direction while being rotated obliquely.

Consequently, in comparison with a case in which the tip end section of the terminal connection section 21C is inserted straight into the holding space S of the connection terminal 70 in the axial line direction, the protruding height of the engaging protruding section 63 can be increased, and the holding force (provisional engaging force) of the terminal connection section 21C for the connection terminal 70 being in the provisional engaging state can be increased. Furthermore, the insertion force at the time when the tip end section of the terminal connection section 21C is inserted into the holding space S of the connection terminal 70 can be decreased, whereby smooth inserted can be performed.

Next, a provisional engaging structure of a terminal fitting and connection terminals according to a third embodiment of the present invention will be described below. The components similar to those of the terminal fitting 10 and the connection terminal 30 according to the first embodiment described above are designated by the same numerals, and their detailed descriptions are omitted.

Figure 12:
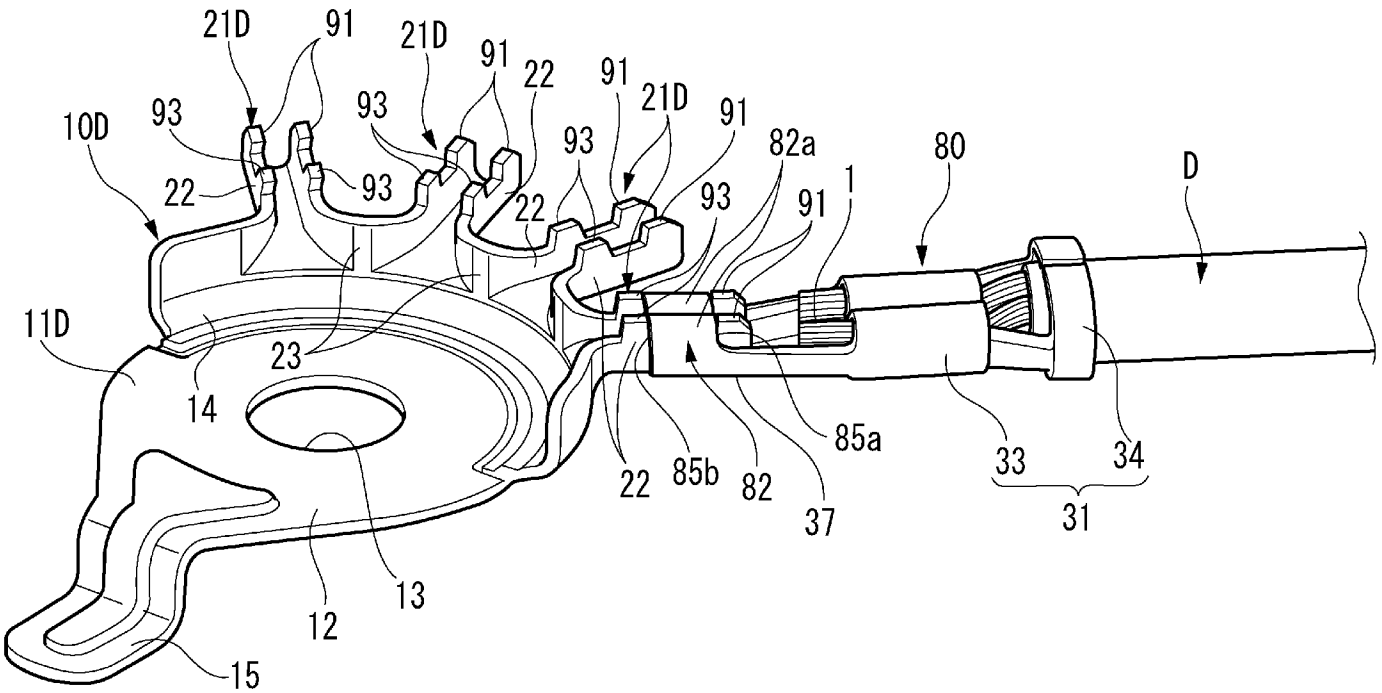
FIG. 12 is a view illustrating a provisional engaging structure of a terminal fitting and a connection terminal according to a third embodiment of the present invention, serving as a perspective view showing the terminal fitting and the connection terminal.
Figure 13A:
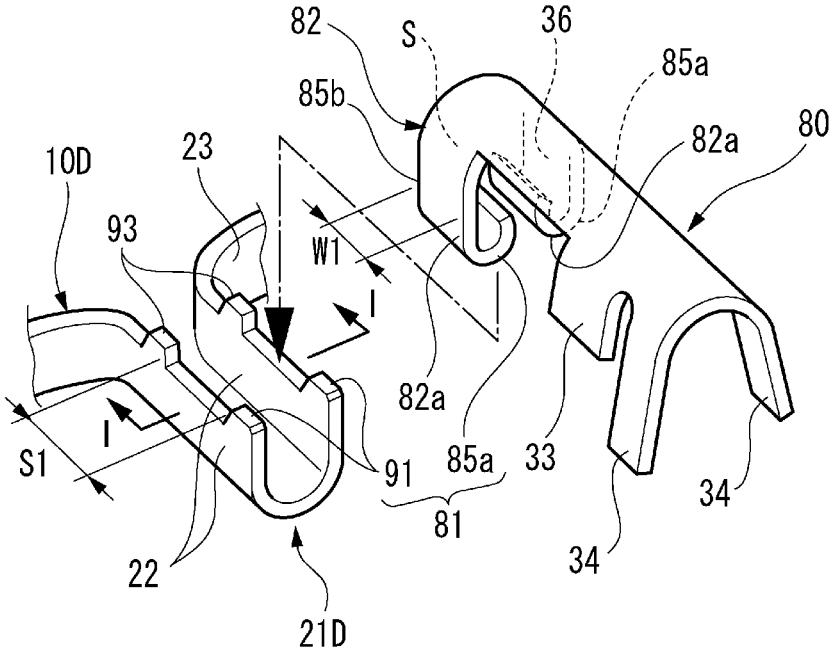
FIG. 13A is a perspective view showing the terminal fitting and the connection terminal according to the third embodiment.

FIG. 12 is a perspective view illustrating a provisional engaging structure of a terminal fitting 10D and connection terminals 80 according to the third embodiment of the present invention. FIG. 13A is a perspective view showing the terminal fitting 10D and the connection terminals 80, and FIG. 13B is a main part perspective view showing the connection terminal 80 provisionally engaged with the terminal connection section 21D.

Figure 13B:
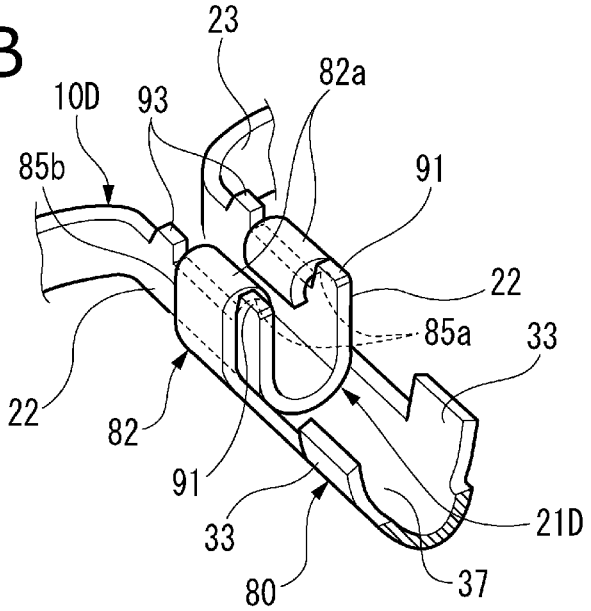
FIG. 13B is a main part perspective view showing the connection terminal provisionally engaged with the terminal connection section.

As shown in FIG. 12 and FIGS. 13A and 13B, the terminal fitting 10D according to the third embodiment has a terminal body 11D and the plurality of terminal connection sections 21D. The terminal fitting 10D is a press-formed product made of a metal plate having conductivity.

The terminal connection sections 21D are integrated with the connection plate section 14 of the terminal body 11D. The terminal connection sections 21D being plural in number are provided on the connection plate section 14. More specifically, the terminal connection sections 21D being three in number are formed on the connection plate section 14. These terminal connection sections 21D are extended from the periphery of the fixing plate section 12 so as to protrude radially at intervals in the width direction thereof.

The engaging walls 22 serving as pair of caulked pieces and protruding to the upper face side, that is, one of the face sides of the terminal connection section 21D, are provided so as to stand upright on both the side sections of the terminal connection section 21D. Hence, each terminal connection section 21D is formed into a U-shape in a front view.

Furthermore, a pair of engaging protruding sections 91 and a pair of engaging protruding sections 93 are provided so as to protrude upward at the tip end sections of the upper end sections of the engaging walls 22 of the terminal connection section 21D. These engaging protruding sections 91 and 93 are provided so as to protrude and so as to be opposed respectively to both the side faces 85*a* and 85*b* of the fastening caulking pieces 82*a* along the connection direction of the connection terminal while a distance S1 slightly larger than the width W1 of the fastening caulking pieces 82*a* in the direction of the connection is provided between the engaging protruding sections 91 and 93 as shown in FIG. 13A.

Furthermore, the engaging protruding sections 91 and 93 are combined with the electric wire-side side faces 85*a* and the terminal fitting-side side faces 85*b* of the pair of fastening caulking pieces 82*a* formed on the fastening connection section 82 of a connection terminal 80 described later to constitute a provisional engaging mechanism 81.

As shown in FIG. 12, the connection terminal 80 has the wire connection section 31 and the fastening connection section 82. The connection terminal 80 provided for the grounding wire D is a press-formed product made of a metal plate having conductivity. The fastening connection section 82 is caulked and fastened to the terminal connection section 21D of the terminal fitting 10D.

The fastening connection section 82 of the connection terminal 80 has the pair of fastening caulking pieces 82*a*. The fastening caulking pieces 82*a* stand upright upward from the bottom section 37 of the connection terminal 80. Furthermore, the upper end sections of the fastening caulking pieces 82*a* are curved inward into a circular arc shape and folded back.

With this configuration, the holding space S enclosed with the fastening caulking pieces 82*a* is formed in the fastening connection section 82 of the connection terminal 80. Both the side faces of the holding space S are nearly vertical faces formed by the fastening caulking pieces 82*a* standing upright upward, and both the side faces are used as the rotation regulating faces 36.

The holding space S of the fastening connection section 82 is formed so as to be slightly larger than the external size of the engaging wall 22 of the terminal connection section 21D and so as to be lower than the height of the engaging protruding sections 91 and 93 in a front view.

Furthermore, as shown in FIG. 13B, the fastening caulking pieces 82*a* of the connection terminal 80, accommodated in the holding space S of the fastening connection section 82, are set to a provisional engaging state while being positioned in the connection direction by the pair of engaging protruding sections 91 and the pair of engaging protruding sections 93 provided so as to protrude at the tip end section of the terminal connection section 21D.

Hence, in the provisional engaging structure of the terminal fitting 10D and the connection terminal 80 according to the third embodiment, in addition to the operational advantage similar to that of the provisional engaging structure of the terminal fitting 10 and the connection terminals 30 according to the first embodiment described above, since the positioning accuracy at the time when the fastening caulking pieces 82*a* of the connection terminal 80 are caulked and fastened to the engaging walls 22 of the terminal fitting 10D is improved, the connection terminal 80 can be caulked and fixed to the terminal connection section 21D of the terminal fitting 10D with high accuracy. However, it is possible to have a configuration in which only the engaging protruding sections 91 are used to set the connection terminal 80 to a provisional engaging state by omitting the engaging protruding sections 93 opposed to the terminal fitting-side side faces 85*b*.

Next, the provisional engaging method of the terminal fitting 10D and the connection terminal 80 according to the third embodiment of the present invention will be described.

Figure 14A:
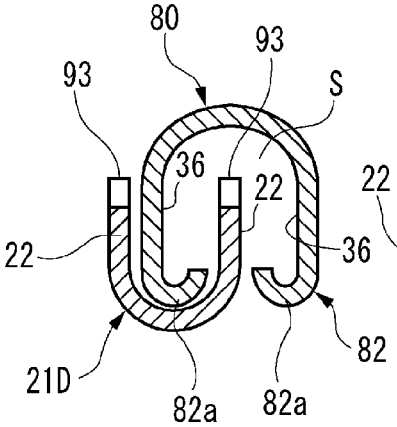
FIGS. 14A to 14F are main part cross-sectional views illustrating the steps of the provisional engaging method of the terminal fitting and the connection terminal according to the third embodiment.

First, as shown in FIG. 14A, the connection terminal 80 is rotated 180 degrees so that the pair of fastening caulking pieces 82*a* of the fastening connection section 82 is opposed to one of the engaging walls 22 (the right engaging wall 22 in the figure) of the terminal connection section 21D, and then the upper end section of the engaging wall 22 between the pair of engaging protruding section 91 and engaging protruding section 93 on the side of the one of the engaging walls 22 (on the side of the base end section of the engaging protruding section 91) is inserted between the pair of fastening caulking pieces 82*a*.

Figure 14B:
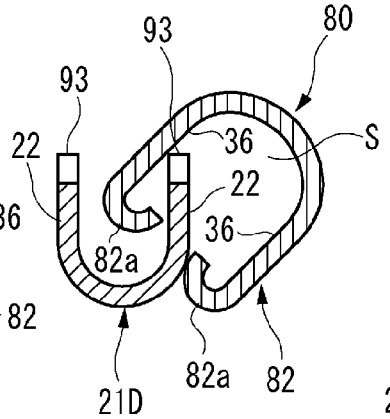
Figure 14C:
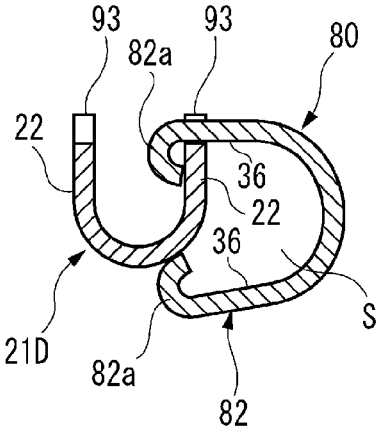

After that, as shown in FIGS. 14B and 14C, the connection terminal 80 is rotated clockwise as shown in the figure around the axial line along the insertion direction of the terminal connection section 21D, and the upper end section of one of the fastening caulking pieces 82*a* is hooked to the upper end section (between the pair of engaging protruding section 91 and the engaging protruding section 93) of one of the engaging walls 22.

Figure 14D:
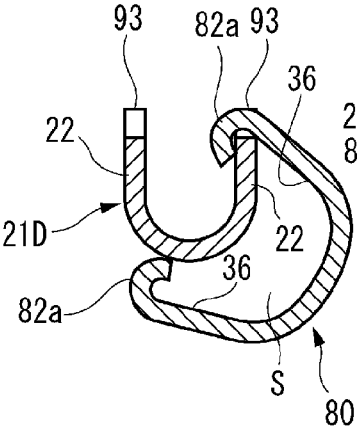
Figure 14E:
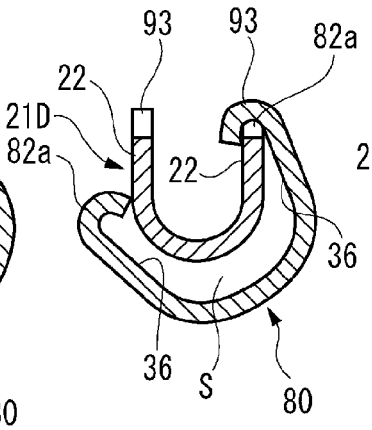

Moreover, as shown in FIGS. 14D and 14E, the connection terminal 80 is further rotated around the axial line along the insertion direction of the terminal connection section 21D by using the upper end section of the one of the engaging walls 22 as a fulcrum. At this time, the upper end section of the other fastening caulking piece 82*a* is moved while making slide contact with the outer circumferential face of the terminal connection section 21D, and the tip ends of the pair of fastening caulking pieces 82*a* is elastically deformed in the widening direction.

Figure 14F:
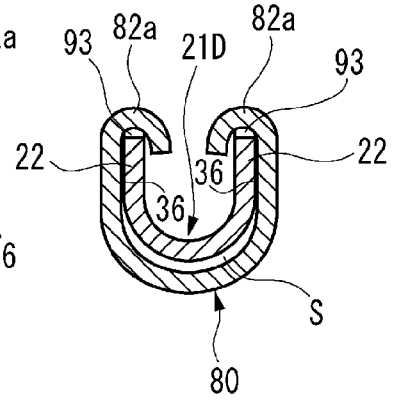

Still further, as shown in FIG. 14F, the connection terminal 80 is rotated until the upper end section of the other fastening caulking piece 82*a* is hooked to the upper end section of the other engaging wall 22 (the left engaging wall 22 in the figure), whereby the fastening caulking pieces 82*a* of the connection terminal 80 are accommodated in the holding space S of the fastening connection section 82.

As a result, as shown in FIG. 13B, the fastening caulking pieces 82*a* of the connection terminal 80 accommodated in the holding space S of the fastening connection section 82 are set to a provisional engaging state so as to be positioned in the connection direction by the pair of engaging protruding sections 91 and the pair of engaging protruding sections 93 provided so as to protrude at the tip end section of the terminal connection section 21D.

In other words, the electric wire-side side faces 85*a* of the fastening caulking pieces 82*a* make contact with the engaging protruding sections 91, whereby engagement is performed therebetween and the terminal connection section 21D is regulated from being moved from the holding space S of the connection terminal 80 in the connection direction of the terminal connection section 21D. Furthermore, when the terminal connection section 21D is inserted into the holding space S, both the side sections of the terminal connection section 21D make contact with the rotation regulating faces 36 formed of both the side faces forming the holding space S, whereby the terminal connection section 21D is held by the fastening connection section 82 of the connection terminal 80 in a state in which the rotation of the terminal connection section 21D around the axial line along the insertion direction thereof is regulated. As a result, the terminal connection section 21D is maintained in a predetermined posture at a predetermined position with respect to the connection terminal 80.

As described above, the pair of engaging protruding sections 91 and the pair of engaging protruding sections 93 are combined with the electric wire-side side faces 85*a* of the fastening caulking pieces 82*a* to constitute the provisional engaging mechanism 81. In other words, in the state in which the electric wire-side side faces 85*a* of the fastening caulking pieces 82*a* are engaged with the engaging protruding sections 91, the movement of the terminal connection section 21D from the holding space S of the connection terminal 80 along the axial line direction of the terminal connection section 21D is regulated.

Although the fastening caulking pieces 82*a* engaged with the engaging protruding sections 91 have a constant holding force for the engaging protruding sections 91 of the engaging walls 22 in the axial line direction of the terminal connection section 21D, the connection terminal 80 can be detached from the terminal connection section 21D by unhooking the upper end section of one of the fastening caulking pieces 82*a* being hooked to the upper end section of one of the engaging walls 22 and by rotating the connection terminal 80 around the axial line along the insertion direction of the terminal connection section 21D (by reversing the procedure shown in FIGS. 14A to 14F.

As described above, the terminal fitting 10D and the connection terminal 80 are equipped with the provisional engaging structure in which the engaging walls 22 of the terminal connection section 21D and the fastening caulking pieces 82*a* are set to a provisional engaging state so as to be detachably engaged by the provisional engaging mechanism 81.

As described above, with the provisional engaging method of the terminal fitting 10D and the connection terminal 80 according to the third embodiment of the present invention, the engaging walls 22 can be accommodated in the holding space S while the fastening caulking pieces 82*a* are not elastically deformed upward by the engaging protruding sections 91. Hence, the protruding height of the engaging protruding sections 91 can be increased, whereby it is possible to increase the holding force (provisional engaging force) of the terminal connection section 21D to the connection terminal 80 that is in the provisional engaging state.

Furthermore, the engaging walls 22 can be accommodated in the holding space S by hooking the upper end section of one of the fastening caulking piece 82*a* to the base end section side of the upper end section of one of the engaging walls 22 from one of the engaging protruding sections 91 and by elastically deforming the tip ends of the pair of fastening caulking pieces 82*a* in the widening direction while rotating the connection terminal 80 around the axial line along the insertion direction of the terminal connection section 21D by using the upper end section of the one of the engaging walls 22 as a fulcrum. Hence, the engaging walls 22 can be accommodated in the holding space S of the connection terminal 80 by applying a slight rotation operation load while holding the electric wire side of the connection terminal 80, whereby the fastening caulking pieces 82*a* can be set to a provisional engaging state. In other words, with the provisional engaging mechanism 81, the rotation operation load at the time when the engaging walls 22 are accommodated in the holding space S is decreased, and the movement of the connection terminal 80 from the holding space S along the axial line direction of the terminal connection section 21D is forcefully regulated, whereby it is possible to obtain a structure in which the terminal connection section 21D is easily fitted and hardly detached.

Next, a provisional engaging structure of a terminal fitting and connection terminals according to a fourth embodiment of the present invention will be described below. The components similar to those of the terminal fitting 10 and the connection terminal 30 according to the first embodiment described above are designated by the same numerals, and their detailed descriptions are omitted.

Figure 15A:
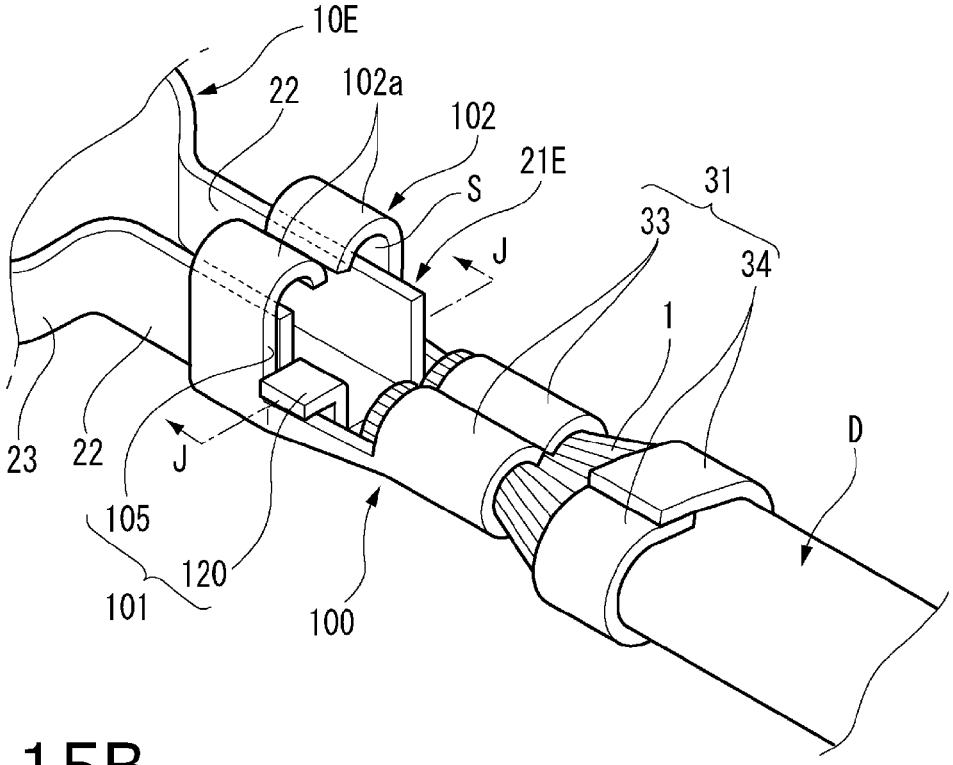
FIGS. 15A and 15B are views illustrating a provisional engaging structure of a terminal fitting and a connection terminal according to a fourth embodiment of the present invention.
Figure 15B:
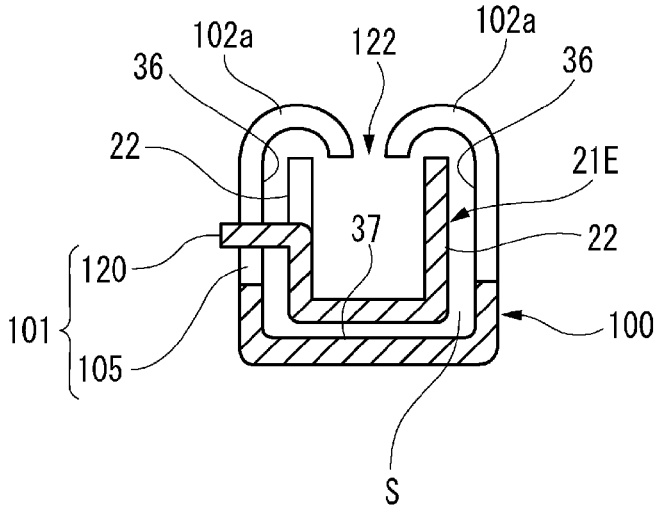
Figure 16A:
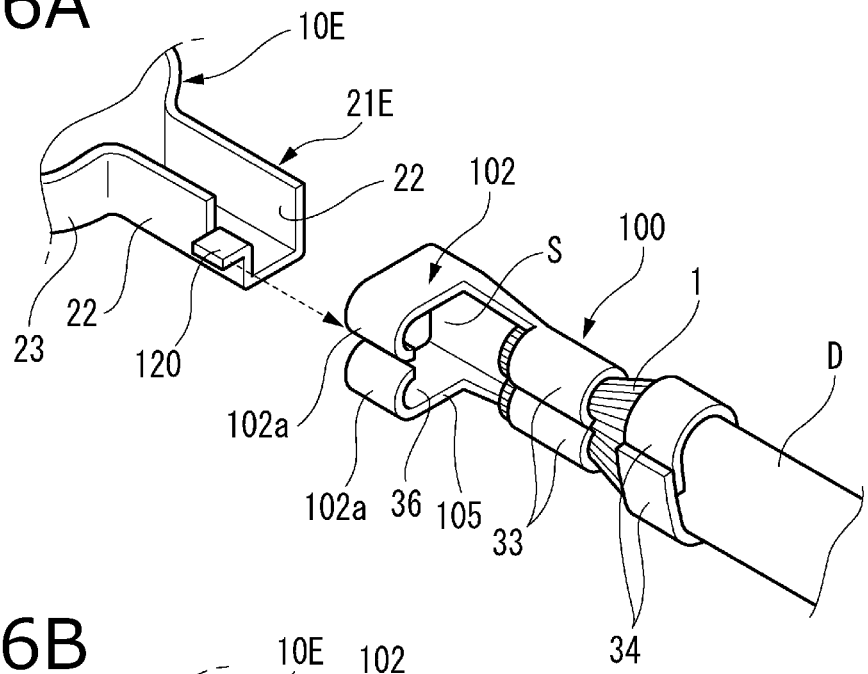
FIGS. 16A and 16B are perspective views illustrating the provisional engaging method of the terminal fitting and the connection terminal according to the fourth embodiment of the present invention.
Figure 16B:
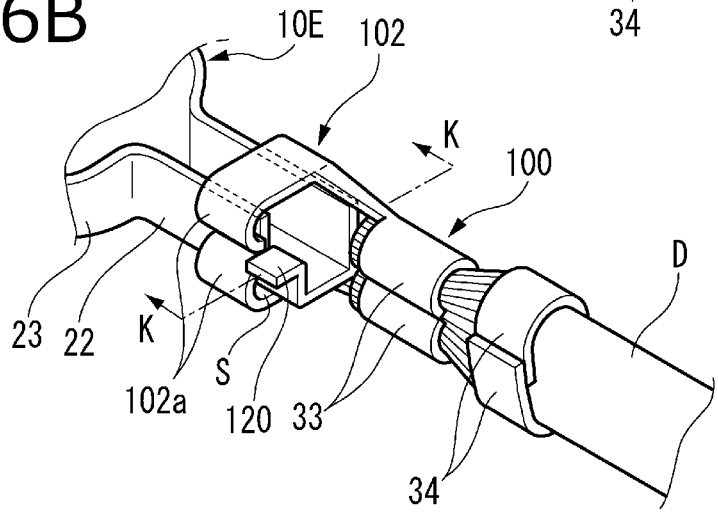
Figure 16C:
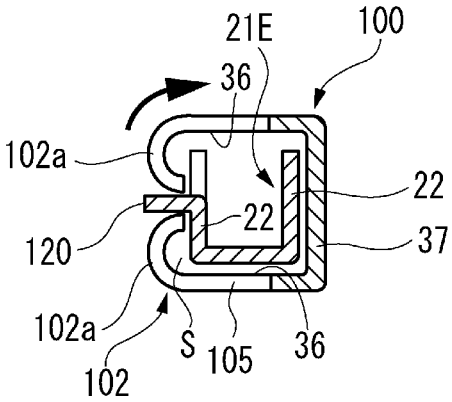
FIG. 16C is a cross-sectional view taken on line K-K of FIG. 16B.

FIGS. 15A and 15B are views illustrating a provisional engaging structure of a terminal fitting 10E and connection terminals 100 according to the fourth embodiment of the present invention. FIGS. 16A to 16C are views illustrating a provisional engaging method of the terminal fitting and the connection terminals according to the fourth embodiment of the present invention.

The terminal fitting 10E according to the fourth embodiment has a plurality of terminal connection sections 21E. However, FIG. 15A shows only one terminal connection section 21E. The terminal fitting 10E is a press-formed product made of a metal plate having conductivity.

The engaging walls 22 serving as pair of caulked pieces and protruding to the upper face side, that is, one of the face sides of the terminal connection section 21E, are provided so as to stand upright on both the side sections of the terminal connection section 21E. Hence, each terminal connection section 21E is formed into a U-shape in a front view.

Furthermore, one of the engaging walls 22 of the terminal connection section 21E has an engaging protruding piece 120 that is formed by cutting and raising the tip end of the upper end section of the engaging wall 22 to the side of the tip end section thereof. In other words, as shown in FIGS. 15A and 15B, the tip end of the engaging protruding piece 120 protrudes to the outside of the tip end section of the upper end section of the one of the engaging walls 22 (the left engaging wall 22 in the figures) so as to make contact with only the electric wire-side side face 105 of one of fastening caulking pieces 102*a* (the left fastening caulking piece 102*a* in the figures).

Furthermore, the engaging protruding piece 120 is combined with the electric wire-side side face 105 of the one of the pair of fastening caulking pieces 102*a* formed on the fastening connection section 102 of the connection terminal 100 described later to constitute a provisional engaging mechanism 101.

As shown in FIG. 15A, the connection terminal 100 has the wire connection section 31 and the fastening connection section 102. The connection terminal 100 provided for the grounding wire D is a press-formed product made of a metal plate having conductivity. The fastening connection section 102 is caulked and fastened to the terminal connection section 21E of the terminal fitting 10E.

The fastening connection section 102 of the connection terminal 100 has the pair of fastening caulking pieces 102*a*. The fastening caulking pieces 102*a* stand upright upward from the bottom section 37 of the connection terminal 100. Furthermore, the upper end sections of the fastening caulking pieces 102*a* are curved inward into a circular arc shape and folded back.

With this configuration, the holding space S enclosed with the fastening caulking pieces 102*a* is formed in the fastening connection section 102 of the connection terminal 100. Both the side faces of the holding space S are nearly vertical faces formed by the fastening caulking pieces 102*a* standing upright upward, and both the side faces are used as the rotation regulating faces 36.

The holding space S of the fastening connection section 102 is formed so as to be slightly larger than the external size of the engaging wall 22 of the terminal connection section 21E.

Furthermore, as shown in FIGS. 15A and 15B, the one of the fastening caulking pieces 102*a* of the connection terminal 100 accommodated in the holding space S of the fastening connection section 102 is set to a provisional engaging state by the engaging protruding piece 120 that is formed by cutting and raising the tip end section of the terminal connection section 21E.

As shown in FIGS. 16A to 16C, when the tip end section of the terminal connection section 21E is inserted into the holding space S of the connection terminal 100, the connection terminal 100 is rotated 90 degrees counterclockwise around the axial line along the insertion direction of the terminal connection section 21E, whereby the engaging protruding piece 120 can pass through the clearance 122 between the pair of fastening caulking pieces 102*a*. Hence, even if the protruding height of the engaging protruding piece 120 is increased, the engaging protruding piece 120 can be inserted smoothly with a small insertion force.

After that, the connection terminal 100 is rotated 90 degrees clockwise around the axial line along the insertion direction of the terminal connection section 21E, whereby the engaging protruding piece 120 is opposed to the electric wire-side side face 105 so as to intersect the one of the fastening caulking pieces 102*a*, and the connection terminal 100 can be set securely to a provisional engaging state with respect to the tip end section of the terminal connection section 21E as shown in FIGS. 15A and 15B.

Next, the provisional engaging method of the terminal fitting 10E and the connection terminal 100 according to the fourth embodiment of the present invention will be described.

First, as shown in FIG. 16A, in a state in which the connection terminal 100 is rotated 90 degrees counterclockwise around the axial line along the insertion direction of the terminal connection section 21E so that the pair of fastening caulking pieces 102*a* of the fastening connection section 102 is aligned with the engaging protruding piece 120 formed on one of the engaging walls 22 (the left engaging wall 22 in the figure), the tip end section of the terminal connection section 21E is inserted into the holding space S such that the engaging protruding piece 120 passes through the clearance 122 between the pair of fastening caulking pieces 102*a*.

The connection terminal 100 is then rotated 90 degrees clockwise around the axial line along the insertion direction of the terminal connection section 21E, whereby the engaging walls 22 are accommodated in the holding space S.

As a result, as shown in FIGS. 15A and 15B, since the engaging protruding piece 120 is opposed to the electric wire-side side face 105 so as to intersect the one of the fastening caulking pieces 102*a*, the connection terminal 100 can be set securely to a provisional engaging state with respect to the tip end section of the terminal connection section 21E.

In other words, the electric wire-side side face 105 of the one of the fastening caulking pieces 102*a* makes contact with the engaging protruding piece 120, whereby engagement is performed therebetween and the terminal connection section 21E is regulated from being moved from the holding space S of the connection terminal 100 in the connection direction. Furthermore, when the terminal connection section 21E is inserted into the holding space S, both the side sections of the terminal connection section 21E make contact with the rotation regulating faces 36 formed of both the side faces forming the holding space S, whereby the terminal connection section 21E is held by the fastening connection section 102 of the connection terminal 100 in a state in which the rotation of the terminal connection section 21E around the axial line along the insertion direction thereof is regulated. As a result, the terminal connection section 21E is maintained in a predetermined posture at a predetermined position with respect to the connection terminal 100.

As described above, the engaging protruding piece 120 is combined with the electric wire-side side face 105 of the fastening caulking piece 102*a* to constitute the provisional engaging mechanism 101. In other words, in the state in which the electric wire-side side face 105 of the fastening caulking piece 102*a* is engaged with the engaging protruding piece 120, the movement of the terminal connection section 21E from the holding space S of the connection terminal 100 along the axial line direction of the terminal connection section 21E is regulated.

Although the fastening caulking piece 102*a* engaged with the engaging protruding piece 120 has a constant holding force for the engaging protruding piece 120 of the engaging wall 22 in the axial line direction of the terminal connection section 21E, when the connection terminal 100 is rotated 90 degrees counterclockwise around the axial line along the insertion direction of the terminal connection section 21E, the clearance 122 between the pair of fastening caulking pieces 102*a* of the fastening connection section 102 is aligned with the engaging protruding piece 120, whereby the connection terminal 100 can be detached from the terminal connection section 21E.

As described above, the terminal fitting 10E and the connection terminal 100 are equipped with a provisional engaging structure in which the engaging wall 22 of the terminal connection section 21E and the fastening caulking piece 102*a* are set to a provisional engaging state so as to be detachably engaged by the provisional engaging mechanism 101.

As described above, with the provisional engaging structure and the provisional engaging method of the terminal fitting 10E and the connection terminal 100 according to the fourth embodiment of the present invention, in addition to the operational advantage similar to that of the provisional engaging structure of the terminal fitting 10 and the connection terminals 30 according to the first embodiment described above, since the tip end section of the terminal connection section 21E is inserted into the holding space S of the connection terminal 100 such that the engaging protruding piece 120 making contact with only the electric wire-side side face 105 of the one of the pair of fastening caulking pieces 102*a* passes through the clearance 122 between the pair of fastening caulking pieces 102*a*, even if the protruding height of the engaging protruding piece 120 is increased, the tip end section of the terminal connection section 21E can be inserted smoothly into the holding space S of the connection terminal 100 with a small insertion force.

After that, the connection terminal 100 is rotated around the axial line along the insertion direction of the terminal connection section 21E, whereby the engaging protruding piece 120 is opposed to the electric wire-side side face 105 so as to intersect the one of the fastening caulking pieces 102*a*, and the connection terminal 100 can be set securely to the provisional engaging state with respect to the tip end section of the terminal connection section 21E.

However, the present invention is not limited to the above-mentioned embodiments, but can be modified or improved as necessary. In addition, the materials, shapes, dimensions, quantities, arrangement positions, etc. of the respective components in the above-mentioned embodiments may be arbitrary and not limited, provided that the present invention can be achieved.

The characteristics of the embodiments of the connection structure and the connection method of the terminal fitting and the provisional engaging structure and the provisional engaging method of the terminal fitting and connection terminals according to the present invention described above will be briefly summarized and listed in the following items [1] to [9].

[1] A provisional engaging structure of a terminal fitting and a connection terminal, including:

a terminal fitting (10, 10A to 10E) having:

a terminal body (11); and a plurality of terminal connection sections (21, 21A to 21E) extended from the terminal body; and a connection terminal (30, 70, 80, 100) configured to be connected to an end section of an electric wire (grounding wire D), wherein the connection terminal has a holding space (S) defined by a pair of fastening caulking pieces (32*a*, 72*a*, 82*a*, 102*a*) provided so as to stand upright on both side sections of the connection terminal and upper end sections of the pair of fastening caulking pieces (32*a*, 72*a*, 82*a*, 102*a*) which are folded back inwardly, the pair of fastening caulking pieces (32*a*, 72*a*, 82*a*, 102*a*) being capable of caulking and fastening the connection terminal to the terminal fitting;

wherein a pair of caulked pieces (engaging walls 22) is provided so as to stand upright on both side sections of each of the terminal connection sections, the pair of caulked pieces being configured to be accommodated in the holding space of the connection terminal; and wherein a provisional engaging mechanism (51, 61, 81, 101) that is detachably engaged with the pair of fastening caulking pieces when the caulked pieces are accommodated in the holding space is provided between the caulked pieces and the pair of fastening caulking pieces.

[2] The provisional engaging structure of the terminal fitting and connection terminals set forth in the above-mentioned item [1], wherein the provisional engaging mechanism (61) includes:

engaging protruding sections (63) respectively provided so as to protrude at tip end sections of the upper end sections of the pair of caulked pieces (engaging walls 22) and so as to make contact with the electric wire-side side faces (75) of the pair of fastening caulking pieces (72*a*); and relief sections (63*c*) respectively provided so as to be cut out at tip end sections of bottom section sides of the pair of caulked pieces to avoid interference with the connection terminal (72) when the tip end section of the terminal connection section (21C) is inserted into the holding space (S) obliquely.

[3] The provisional engaging structure of the terminal fitting and connection terminals set forth in the above-mentioned item [1], wherein the provisional engaging mechanism (81) includes a pair of engaging protruding sections (91, 93) provided so as to protrude at tip end sections of upper end sections of the caulked pieces (engaging walls 22) and so as to be respectively opposed to both side faces (electric wire-side side faces 85*a* and terminal fitting-side side faces 85*b*) of the pair of fastening caulking pieces (82*a*) along a connection direction of the connection terminal (80).

[4] The provisional engaging structure of the terminal fitting and connection terminals set forth in the above-mentioned item [1], wherein the provisional engaging mechanism (101) includes an engaging protruding piece (120) provided so that a tip end of the upper end section of one of the caulked pieces (engaging wall 22) is bent to outside of the tip end section thereof so as to make contact with only the electric wire-side side face (105) of one of the pair of fastening caulking pieces (102*a*).

[5] A connection structure of a terminal fitting, wherein the pair of fastening caulking pieces (32*a*, 72*a*, 82*a*, 102*a*) of the connection terminal (30, 70, 80, 100) set forth in the above-mentioned item [1] is caulked to the caulked pieces (engaging walls 22), and the connection terminal is caulked and fastened to the terminal fitting (10, 10A to 10E).

[6] A provisional engaging method of a terminal fitting (10, 10A to 10E) and a connection terminal (30, 70, 80, 100) in a connection of the terminal fitting having a terminal body (11) and a plurality of terminal connection sections (21, 21A to 21E) extended from the terminal body, a pair of fastening caulking pieces (32*a*, 72*a*, 82*a*, 102*a*) of the connection terminal (30, 70, 80, 100) connected to an end section of an electric wire (grounding wire D) caulking to a pair of caulked pieces (engaging walls 22) provided on both side sections of the terminal connection section, the provisional engaging method including:

forming a holding space (S) configured to accommodate the pair of caulked pieces in the connection terminal by folding back inward upper end sections of the pair of fastening caulking pieces provided so as to stand upright on both side sections of the connection terminal; and detachably engaging the pair of fastening caulking pieces with the pair of caulked pieces using a provisional engaging mechanism (51, 61, 81, 101) provided between the terminal connection section and the connection terminal by inserting the caulked pieces into the holding space.

[7] The provisional engaging method of the terminal fitting and connection terminals set forth in the above-mentioned item [6], wherein the provisional engaging mechanism (81) includes engaging protruding sections (91) provided so as to protrude at tip end sections of upper end sections of the caulked pieces (engaging walls 22) and so as to make contact with the electric wire-side side faces (85*a*) of the fastening caulking pieces (82*a*); and wherein the upper end section of one of the fastening caulking pieces is hooked to a base end section side portion of the upper end section of one of the caulked pieces, and the connection terminal (80) is rotated around an axis along an insertion direction of the terminal connection section (21D) by using the upper end section of the one of the caulked pieces as a fulcrum, whereby the caulked pieces are accommodated into the holding space (S).

[8] The provisional engaging method of the terminal fitting and connection terminals set forth in the above-mentioned item [6], wherein the provisional engaging mechanism (101) includes an engaging protruding piece (120) provided so that a tip end of the upper end section of one of the caulked pieces (engaging wall 22) is bent to outside of the tip end section thereof so as to make contact with only the electric wire-side side face (105) of one of the pair of the fastening caulking pieces (102*a*); and wherein the tip end section of the terminal connection section (21E) is inserted into the holding space (S) by passing the engaging protruding piece through a clearance between the pair of fastening caulking pieces, and then the connection terminal (100) is rotated around an axis along an insertion direction of the terminal connection section, whereby the caulked pieces are accommodated into the holding space.

[9] A connection method of a terminal fitting (10, 10A to 10E) having a terminal body (11) and a plurality of terminal connection sections (21, 21A to 21E) extended from the terminal body, a pair of fastening caulking pieces (32*a*, 72*a*, 82*a*, 102*a*) of a connection terminal (30, 70, 80, 100) connected to an end section of an electric wire (grounding wire D) caulking to a pair of caulked pieces (engaging walls 22) provided on both side sections of the terminal connection section, the connection method comprising:

forming a holding space (S) configured to accommodate the pair of caulked pieces in the connection terminal by folding back inward upper end sections of the pair of fastening caulking pieces provided so as to stand upright on both side sections of the connection terminal;

detachably engaging the pair of fastening caulking pieces with the pair of caulked pieces using a provisional engaging mechanism (51, 61, 81, 101) provided between the terminal connection section and the connection terminal by inserting the caulked pieces into the holding space; and caulking the pair of caulked pieces inside the holding space by crushing the fastening caulking pieces.

What is claimed is:

1. A provisional engaging structure of a terminal fitting and a connection terminal, comprising:

the terminal fitting comprising:

a terminal body; and a plurality of terminal connection sections extended from the terminal body; and the connection terminal configured to be connected to an end section of an electric wire, wherein the connection terminal has a holding space defined by a pair of fastening caulking pieces provided so as to stand upright on both side sections of the connection terminal and upper end sections of the pair of fastening caulking pieces which are folded back inwardly, the pair of fastening caulking pieces being capable of caulking and fastening the connection terminal to the terminal fitting;

wherein a pair of caulked pieces is provided so as to stand upright on both side sections of the terminal connection section and is configured to be accommodated in the holding space of the connection terminal; and wherein a provisional engaging mechanism that is detachably engaged with the pair of fastening caulking pieces when the pair of caulked pieces is accommodated in the holding space is provided between the pair of caulked pieces and the pair of fastening caulking pieces.

2. The provisional engaging structure according to claim 1, wherein the provisional engaging mechanism comprises:

engaging protruding sections respectively provided so as to protrude at tip end sections of the upper end sections of the pair of caulked pieces and so as to make contact with the electric wire-side side faces of the pair of fastening caulking pieces; and relief sections respectively provided so as to be cut out at tip end sections of bottom section sides of the pair of caulked pieces to avoid interference with the connection terminal when the tip end section of the terminal connection section is inserted into the holding space obliquely.

3. The provisional engaging structure according to claim 1, wherein the provisional engaging mechanism comprises a pair of engaging protruding sections provided so as to protrude at tip end sections of upper end sections of the pair of caulked pieces and so as to be respectively opposed to both side faces of the pair of fastening caulking pieces along a connection direction of the connection terminal.

4. The provisional engaging structure according to claim 1, wherein the provisional engaging mechanism comprises an engaging protruding piece provided so that a tip end of the upper end section of one of the caulked piece is bent to outside of the tip end section thereof so as to make contact with only the electric wire-side side face of one of the pair of fastening caulking pieces.

5. A connection structure of a terminal fitting, wherein the pair of fastening caulking pieces of the connection terminal according to claim 1 is caulked to the pair of caulked pieces, and the connection terminal is caulked and fastened to the terminal fitting.

6. A provisional engaging method of a terminal fitting and a connection terminal in a connection of the terminal fitting having a terminal body and a plurality of terminal connection sections extended from the terminal body, a pair of fastening caulking pieces of the connection terminal connected to an end section of an electric wire caulking to a pair of caulked pieces provided on both side sections of the terminal connection section, the provisional engaging method comprising:

forming a holding space capable configured to accommodate the pair of caulked pieces in the connection terminal by folding back inward upper end sections of the pair of fastening caulking pieces provided so as to stand upright on both side sections of the connection terminal; and detachably engaging the pair of fastening caulking pieces with the pair of caulked pieces using a provisional engaging mechanism provided between the terminal connection section and the connection terminal by inserting the pair of caulked pieces into the holding space.

7. The provisional engaging method according to claim 6, wherein the provisional engaging mechanism comprises engaging protruding sections provided so as to protrude at tip end sections of upper end sections of the pair of caulked pieces and so as to make contact with the electric wire-side side faces of the fastening caulking pieces; and wherein the upper end section of one of the fastening caulking pieces is hooked to a base end section side portion of the upper end section of one of the pair of caulked pieces, and the connection terminal is rotated around an axis along an insertion direction of the terminal connection section by using the upper end section of the one of the pair of caulked pieces as a fulcrum, whereby the pair of caulked pieces is accommodated into the holding space.

8. The provisional engaging method according to claim 6, wherein the provisional engaging mechanism comprises an engaging protruding piece provided so that a tip end of the upper end section of one of the caulked pieces is bent to outside of the tip end section thereof so as to make contact with only the electric wire-side side face of one of the pair of the fastening caulking pieces; and wherein the tip end section of the terminal connection section is inserted into the holding space by passing the engaging protruding piece through a clearance between the pair of fastening caulking pieces, and then the connection terminal is rotated around an axis along an insertion direction of the terminal connection section, whereby the pair of caulked pieces is accommodated into the holding space.

9. A connection method of a terminal fitting having a terminal body and a plurality of terminal connection sections extended from the terminal body, a pair of fastening caulking pieces of a connection terminal connected to an end section of an electric wire caulking to a pair of caulked pieces provided on both side sections of the terminal connection section, the connection method comprising:

forming a holding space configured to accommodate the pair of caulked pieces in the connection terminal by folding back inward upper end sections of the pair of fastening caulking pieces provided so as to stand upright on both side sections of the connection terminal;

detachably engaging the pair of fastening caulking pieces with the pair of caulked pieces using a provisional engaging mechanism provided between the terminal connection section and the connection terminal by inserting the pair of caulked pieces into the holding space; and caulking the pair of caulked pieces inside the holding space by crushing the fastening caulking pieces.

* * * * *